US011201394B2

(12) United States Patent
Jia

(10) Patent No.: US 11,201,394 B2
(45) Date of Patent: Dec. 14, 2021

(54) ANTENNA DEVICE AND ELECTRONIC DEVICE

(71) Applicant: GUANGDONG OPPO MOBILE TELECOMMUNICATIONS CORP., LTD., Guangdong (CN)

(72) Inventor: Yuhu Jia, Guangdong (CN)

(73) Assignee: SHENZHEN HEYTAP TECHNOLOGY CORP., LTD., Guangdong (CN)

( * ) Notice: Subject to any disclaimer, the term of this patent is extended or adjusted under 35 U.S.C. 154(b) by 0 days.

(21) Appl. No.: 16/925,539

(22) Filed: Jul. 10, 2020

(65) Prior Publication Data

US 2021/0036415 A1 Feb. 4, 2021

(30) Foreign Application Priority Data

Jul. 30, 2019 (CN) ..... 201910695669.X

(51) Int. Cl.
*H01Q 1/40* (2006.01)
*H01Q 1/42* (2006.01)
(Continued)

(52) U.S. Cl.
CPC ..... *H01Q 1/405* (2013.01); *H01Q 1/38* (2013.01); *H01Q 5/10* (2015.01)

(58) Field of Classification Search
CPC ..... H01Q 1/405; H01Q 1/42; H01Q 1/422; H01Q 1/425; H01Q 1/22; H01Q 1/2266;
(Continued)

(56) References Cited

U.S. PATENT DOCUMENTS 7,385,560 B1 6/2008 Maloratsky et al.
2010/0097281 A1 4/2010 Wu et al.
(Continued)

FOREIGN PATENT DOCUMENTS

CN 101826657 9/2010
CN 201994420 9/2011
(Continued)

OTHER PUBLICATIONS

"3rd Generation Partnership Project; Technical Specification Group Radio Access Network; NR; User Equipment (UE) radio transmission and reception; Part 2: Range 2 Standalone (Release 16)," 3GPP TS 38.101-2, Jun. 2020, V16.4.0, 169 pages.
(Continued)

*Primary Examiner* — Hoang V Nguyen
(74) *Attorney, Agent, or Firm* — Hodgson Russ LLP

(57) ABSTRACT

An antenna device and an electronic device are provided. The antenna device includes an antenna radome and an antenna module. The antenna radome includes a dielectric substrate and a resonance structure carried on the dielectric substrate. The antenna module is spaced apart from the antenna radome and configured to perform at least one of receiving and transmitting a radio frequency signal of a preset frequency band in a radiation direction which is directed toward the dielectric substrate and the resonance structure. The resonance structure has an in-phase reflection characteristic for the radio frequency signal of the preset frequency band, and a distance between a radiation surface of the antenna module and a surface of the resonance structure facing the antenna module is determined by a reflection phase difference of the antenna radome and a wavelength of the radio frequency signal of the preset frequency band transmitted in air.

19 Claims, 26 Drawing Sheets

(51) Int. Cl.
*H01Q 5/10* (2015.01)
*H01Q 1/38* (2006.01)

(58) Field of Classification Search
CPC ..... H01Q 1/243; H01Q 1/48; H01Q 1/50; H01Q 5/10; H01Q 5/20; H01Q 5/307; H01Q 15/0013; H01Q 15/0026; H01Q 21/065
See application file for complete search history.

(56) References Cited

U.S. PATENT DOCUMENTS

| | | | |
|---|---|---|---|
| 2013/0222200 | A1 | 8/2013 | Ju |
| 2013/0323579 | A1 | 12/2013 | Hwang et al. |
| 2014/0111400 | A1 | 4/2014 | Latrach et al. |
| 2014/0285394 | A1 | 9/2014 | Truthan |

FOREIGN PATENT DOCUMENTS

| | | | | | |
|---|---|---|---|---|---|
| CN | 102760963 | A | * | 10/2012 | ..... H01Q 1/42 |
| CN | 102760967 | | | 10/2012 | |
| CN | 106169652 | | | 11/2016 | |
| CN | 106887692 | A | * | 6/2017 | ..... H01Q 1/42 |
| CN | 207038717 | | | 2/2018 | |
| CN | 107834195 | | | 3/2018 | |
| CN | 109066080 | | | 12/2018 | |
| EP | 0301580 | | | 2/1989 | |
| KR | 20120027985 | | | 3/2012 | |
| WO | 2007123504 | | | 11/2007 | |

OTHER PUBLICATIONS

"3rd Generation Partnership Project; Technical Specification Group Radio Access Network; Study on new radio access technology: Radio Frequency (RF) and co-existence aspects (Release 14)," 3GPP TR 38.803, Sep. 2017, V14.2.0, 205 pages.

Shi, "Design of Low Profile Dipole Antenna Based on Artificial Magnetic Conductor" Dissertation Submitted to Southeast University for the Academic Degree of Master of Engineering, Apr. 2016, 60 pages.

Feng, "Research of Wideband Antenna Based on Artificial Magnetic Conductor", Dissertation for the Master's Degree in Engineering, Harbin Institute of Technology, Jul. 2016, 65 pages.

Wang, "Research and application of artificial magnetic conductor structure application in antenna", Master's Degree of Electromagnetic field and microwave Technology, Nanjing University of Science and Technology, Mar. 2012, 61 pages.

WIPO, English translation of the ISR and WO for PCT/CN2020/100671, Sep. 11, 2020.

Vaidya et al., "Efficient high gain wideband antenna with circular array of square parasitic patches," IEEE Asia-Pacific Conference on Antennas and Propagation, 2012, 2 pages.

Ullah et al., "A new metasurface reflective structure for simultaneous enhancement of antenna bandwidth and gain," Smart Materials and Structures, 2014, vol. 23, No. 8, 7 pages.

Banerjee et al., "Enhancing the gain of a HMSIW Based Semicircular Antenna using Antenna-FSS Composite Structure," IEEE, International Conference on Opto-Electronics and Applied Optics (Optronix), 2019, 4 pages.

Ourir et al., "Bidimensional phase-varying metamaterial for steering beam antenna," Proceedings of SPIE, IEEE, 2007, vol. 6581, 11 pages.

EPO, Extended European Search Report for EP Application No. 20184021.2 , dated Dec. 23, 2020.

SIPO, First Office Action for CN Application No. 201910695669.X, dated Mar. 26, 2021.

* cited by examiner

120c

120c

120c

120c

120c

120c

120c

ANTENNA DEVICE AND ELECTRONIC DEVICE

CROSS-REFERENCE TO RELATED APPLICATION

This application claims priority to Chinese Patent Application No. 201910695669.X, filed Jul. 30, 2019, the entire disclosure of which is incorporated herein by reference.

TECHNICAL FIELD

This disclosure relates to the technical field of electronics, and particularly to an antenna device and an electronic device.

BACKGROUND

Millimeter wave has characteristics of high carrier frequency and large bandwidth, and can achieve the ultra-high data transmission rate of the fifth generation (5G) mobile communication standard. As the working frequency of millimeter wave is higher, the propagation loss of millimeter wave is higher in wireless transmission, which in turn leads to a shorter wireless propagation distance. Therefore, in practical applications, antenna units should be presented in array, to achieve higher antenna gain, overcome the high propagation loss, and achieve a longer propagation distance. With the same antenna units, forming an antenna array with high antenna gain poses a challenge to the spatial arrangement of the antenna array in an electronic device.

SUMMARY

Embodiments of the disclosure provide an antenna device and an electronic device.

Embodiments of the disclosure provide an antenna device. The antenna device includes an antenna radome and an antenna module. The antenna radome includes a dielectric substrate and a resonance structure carried on the dielectric substrate. The antenna module is spaced apart from the antenna radome and configured to perform at least one of receiving and transmitting a radio frequency signal of a preset frequency band in a radiation direction which is directed toward the dielectric substrate and the resonance structure. The resonance structure has an in-phase reflection characteristic for the radio frequency signal of the preset frequency band, and a distance between a radiation surface of the antenna module and a surface of the resonance structure facing the antenna module is determined by a reflection phase difference of the antenna radome and a wavelength of the radio frequency signal of the preset frequency band transmitted in air.

Embodiments of the disclosure provide an electronic device. The electronic device includes a main board and the antenna device of the above. The antenna module is electrically coupled with the main board and is configured to perform at least one of receiving and transmitting a radio frequency signal through the antenna radome under control of the main board.

BRIEF DESCRIPTION OF THE DRAWINGS

To describe technical solutions in embodiments of the present disclosure more clearly, the following briefly introduces accompanying drawings required for illustrating the disclosure. Apparently, the accompanying drawings in the following description illustrate some embodiments of the present disclosure. Those of ordinary skill in the art may also obtain other drawings based on these accompanying drawings without creative efforts.

DETAILED DESCRIPTION

To describe technical solutions in embodiments of the present disclosure more clearly, the following briefly introduces accompanying drawings required for illustrating the disclosure. The accompanying drawings in the following description illustrate some implementations of the present disclosure. Those of ordinary skill in the art may also obtain other drawings based on these accompanying drawings without creative effort.

Figure 1:
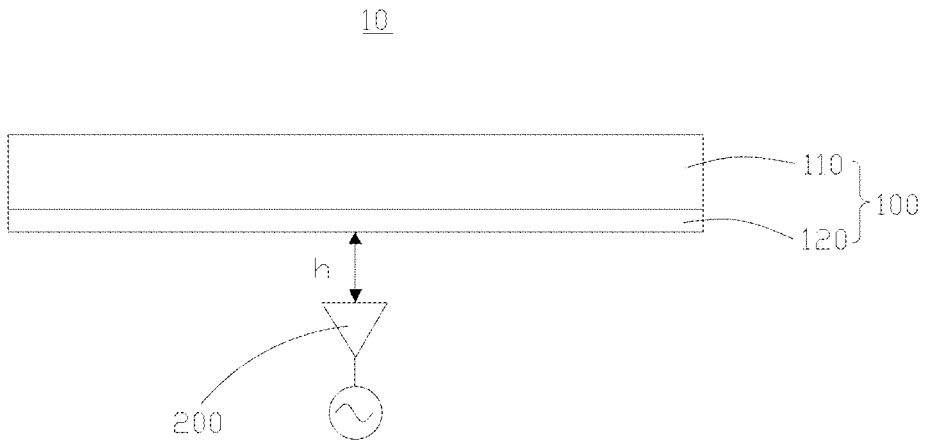
FIG. 1 is a schematic structural diagram illustrating an antenna device according to embodiments.
Figure 2:
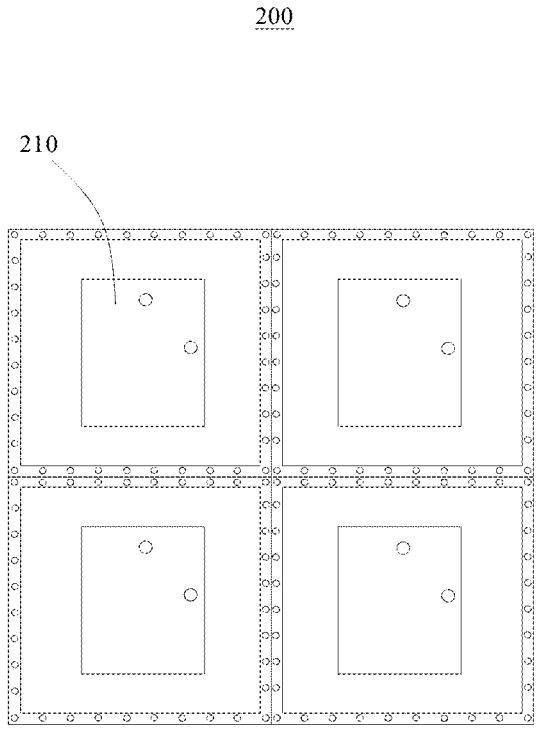
FIG. 2 is a top view of an antenna module of the antenna device in FIG. 1.

Referring to FIG. 1 and FIG. 2, an antenna device 10 according to embodiments of the present disclosure includes an antenna radome (also called antenna housing) 100 and an antenna module 200. The antenna radome 100 includes a dielectric substrate 110 and a resonance structure 120 carried on the dielectric substrate 110. The antenna module 200 is spaced apart from the antenna radome 100 and configured to receive/transmit (or receive/emit) a radio frequency signal of a preset frequency band in a radiation direction, where the radiation direction is directed toward the dielectric substrate 110 and the resonance structure 120. The resonance structure 120 can have an in-phase reflection characteristic for the radio frequency signal of the preset frequency band, and a distance h between a radiation surface of the antenna module 200 and a surface of the resonance structure 120 facing the antenna module 200 is determined by a reflection phase difference of the antenna radome 100 and a wavelength of the radio frequency signal of the preset frequency band transmitted in air.

In an example, the antenna module 200 can include one antenna radiating body 210, or can be an antenna array including multiple antenna radiating bodies 210. The antenna module 200 can be a 2×2 antenna array, a 2×4 antenna array, or a 4×4 antenna array. When the antenna module 200 includes multiple antenna radiating bodies 210, the multiple antenna radiating bodies 210 can work in the same frequency band or work in different frequency bands. In the case that the multiple antenna radiating bodies 210 work in different frequency bands, the frequency range of the antenna module 200 can be expanded.

The preset frequency band at least includes all-bands of millimeter wave of the 3rd generation partnership project (3GPP). The dielectric substrate 110 is used to perform spatial impedance matching on the radio frequency signal of the preset frequency band. The dielectric substrate 110 and the resonance structure 120 together can constitute the antenna radome 100, and the antenna module 200 and the antenna radome 100 may be spaced apart. A portion of the dielectric substrate 110 corresponding to the resonance structure 120 is located in a range of the radiation direction of receiving/transmitting the radio frequency signal of the preset frequency band by the antenna module 200, meaning that the beam of the antenna module 200 and the portion of the dielectric substrate 110 corresponding to the resonance structure 120 can be spatially overlapped. The resonance structure 120 can have an in-phase reflection characteristic, where the in-phase reflection characteristic refers to a characteristic of occurring partial reflection and partial transmission when the radio frequency signal passes through the resonance structure 120, with a reflected radio frequency signal and a transmitted radio frequency signal having the same phase. Since the resonance structure 120 can have the in-phase reflection characteristic, the directivity and gain of the antenna module 200 at a specific distance below the dielectric substrate 110 may be improved. The radiation surface of the antenna module 200 refers to a surface of the antenna module 200 used to receive/transmit a radio frequency signal(s).

In at least one embodiment, the resonance structure 120 is located on a side of the dielectric substrate 110, facing the antenna module 200, and the resonance structure 120 has an in-phase reflection characteristic.

Figure 3:
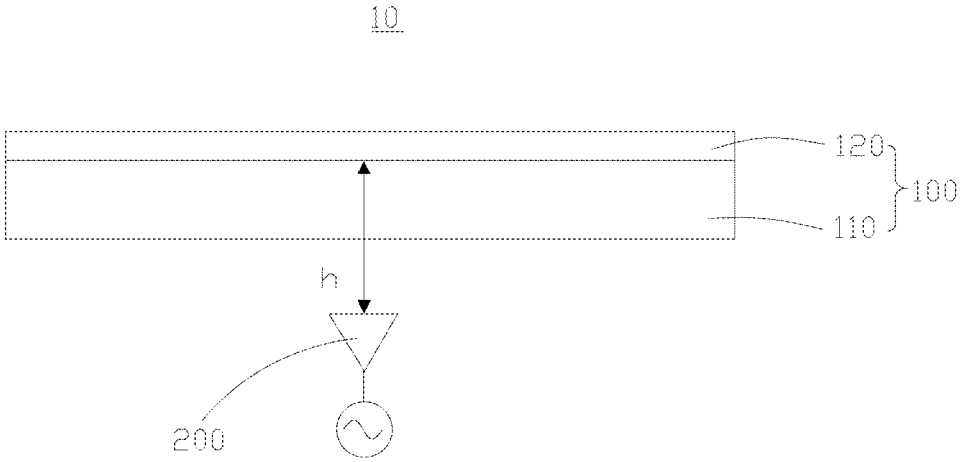
FIG. 3 is a schematic structural diagram illustrating an antenna device according to other embodiments.

Referring to FIG. 3, in at least one embodiment, the resonance structure 120 is located on a side of the dielectric substrate 110, away from the antenna module 200, and the resonance structure 120 has an in-phase reflection characteristic.

Figure 4:
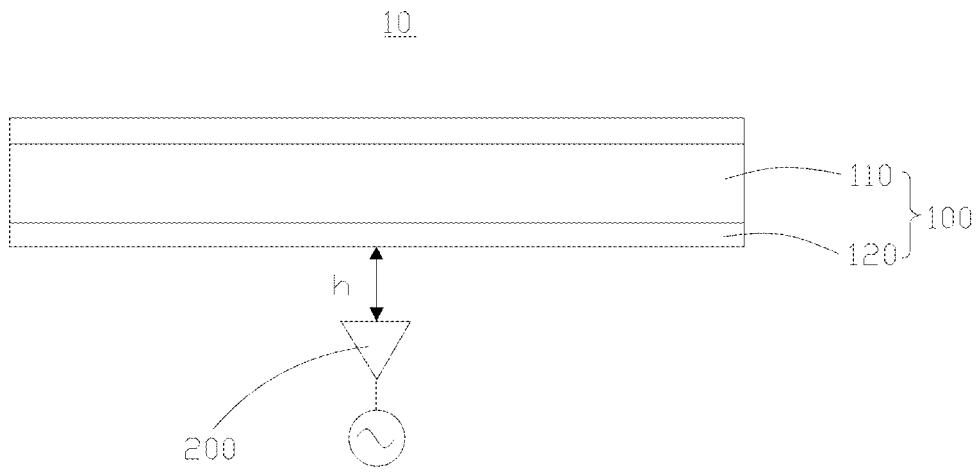
FIG. 4 is a schematic structural diagram illustrating an antenna device according to other embodiments.

Referring to FIG. 4, in at least one embodiment, the resonance structure 120 is partially located on the side of the dielectric substrate 110, away from the antenna module 200, and partially located on the side of the dielectric substrate 110 facing the antenna module 200, and the resonance structure 120 has the in-phase reflection characteristic.

According to the antenna device 10 of embodiments of the present disclosure, the dielectric substrate 110 can be provided with a resonance structure 120 and the resonance structure 120 may have an in-phase reflection characteristic for the radio frequency signal of the preset frequency band. It is possible to shorten the distance h between the radiation surface of the antenna module 200 and the surface of the resonance structure 120 away from the dielectric substrate 110 and further to reduce the size of the electronic device.

In at least one embodiment, the distance between the radiation surface of the antenna module 200 and the surface of the resonance structure 120 facing the antenna module 200 satisfies a preset distance formula. The preset distance formula can include the reflection phase difference of the antenna radome 100 and the wavelength (or propagation wavelength) of the radio frequency signal of the preset frequency band transmitted by the antenna module 200 in the air.

In detail, the preset distance formula is:

$$h = \left(\frac{\phi R}{\pi} - 1\right)\frac{\lambda_0}{4} + N\frac{\lambda_0}{2},$$

where h represents a length of a center line from the radiation surface of the antenna module 200 to the surface of the resonance structure 120 facing the antenna module 200, the center line is a straight line perpendicular to the radiation surface of the antenna module 200, $\phi R$ represents the reflection phase difference of the antenna radome 100, $\lambda_0$ represents the wavelength of the radio frequency signal transmitted by the antenna module 200 in the air, and N is a positive integer.

In detail, h denotes the length from the radiation surface of the antenna module 200 to the surface of the resonance structure 120 facing the antenna module 200, and when a distance between the antenna module 200 and the resonance structure 120 satisfies the above distance formula, the resonance structure 120 can have the in-phase reflection characteristic for the radio frequency signal of the preset frequency band. It may be beneficial to improve the directivity of a radio frequency signal, compensate for loss of the radio frequency signal in wireless transmission, and achieve a longer wireless transmission distance, thereby improving the overall radiation performance of the antenna module 200.

In at least one embodiment, when $\phi R=0$ and N=1, i.e., in-phase reflection is met, the length of the center line from the radiation surface of the antenna module 200 to the surface of the resonance structure 120 facing the antenna module 200 is $$\frac{\lambda_0}{4},$$

which shortens the distance between the resonance structure 120 and the antenna module 200, further reducing the thickness of the electronic device 1. If the dielectric substrate 110 is not provided with the resonance structure 120, $\phi R$ is in a reverse reflection range of (−90°~−180°) or (90°~180°). According to the preset distance formula, the distance from the dielectric substrate 110 to the antenna module 200 may be an integral multiple of half-wavelength. Due to the existence of resonance structure 120, the deviation of $\phi R$ is ±180°. Therefore, when the dielectric substrate 110 is provided with the resonance structure 120, the distance between the radiation surface of the antenna module 200 and the surface of the resonance structure 120 facing the antenna module 200 is an integral multiple of a quarter wavelength. It can therefore be possible to shorten the distance between the resonance structure 120 and the antenna module 200, and further reduce the thickness of the electronic device 1.

In at least one embodiment, a directivity coefficient of the antenna module 200 has a maximum value, and the maximum value is $$D_{max} = \frac{1 + \phi R}{1 - \phi R}.$$

The "directivity coefficient" can refer to a parameter indicating the degree to which the antenna module radiates radio frequency signals in a certain direction (that is, the sharpness of the directional pattern). Because radiation intensities of the antenna module (for example, a directional antenna) are not equal in all directions, the directivity coefficient of the antenna module varies with the position of the observation point. The directivity coefficient is largest in the direction of the largest radiating electric field. Generally, if not specified, the directivity coefficient of the maximum radiation direction is used as the directivity coefficient of the antenna module.

For example, in the case that the distance between the radiation surface of the antenna module 200 and the surface of the resonance structure 120 facing the antenna module 200 meets the preset distance formula, the directivity coefficient of the antenna module 200 reaches the maximum value and the maximum value is $$\frac{1 + \phi R}{1 - \phi R}.$$

This can improve the gain of the antenna module 200.

In at least one embodiment, the antenna radome has a thickness satisfying the following formula:

$$(n-1)\times\frac{\lambda_1}{2} < d < n\times\frac{\lambda_1}{2}, \lambda_1 = \frac{\lambda_0}{\sqrt{\varepsilon}};$$

where d represents the thickness of the antenna radome 100, $\lambda_1$ represents a wavelength of the radio frequency signal transmitted by the antenna module 200 in the antenna radome 100, $\lambda_0$ represents a wavelength of the radio frequency signal transmitted by the antenna module 200 in the air, ε represents an effective dielectric constant of the antenna radome 100, and n is a positive integer.

The formula $\lambda_0=C/f$ can be used to calculate a free space wavelength corresponding to an operating frequency of the antenna device 10, where $\lambda_0$ represents the free space wavelength, i.e., a wavelength propagating in the air, C represents the speed of light, and f represents the operating frequency of the antenna device 10.

When the thickness d of the antenna radome 100 is half-wavelength $\lambda_1/2$ or an integral multiple of half-wavelength $\lambda_1/2$, the radio frequency signal transmitted by the antenna module 200 has the strongest penetration ability in the antenna radome 100. Therefore, the value range of the thickness of antenna radome 100 is set to $[(n-1)\times\lambda_1/2, n\times\lambda_1/2]$, where n is a positive integer. Correspondingly, the radio frequency signal reflected by the antenna radome 100 and the radio frequency signal transmitted by the antenna module 200 can be superimposed to enhance directivity and gain of a radio frequency signal beam, to compensate for the loss of the radio frequency signal during wireless transmission, and to achieve a longer wireless propagation distance, thereby improving the overall performance of antenna device 10.

Figure 5:
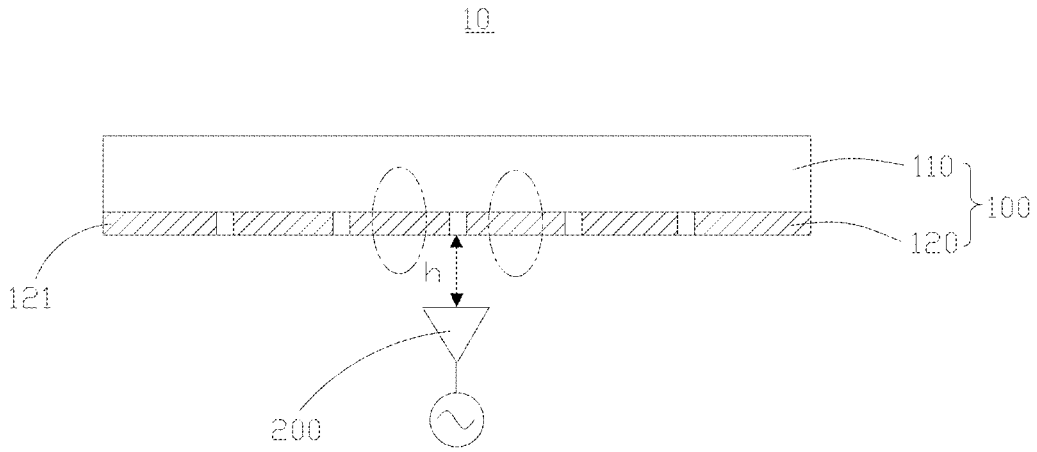
FIG. 5 is a schematic structural diagram illustrating an antenna device according to other embodiments.
Figure 6:
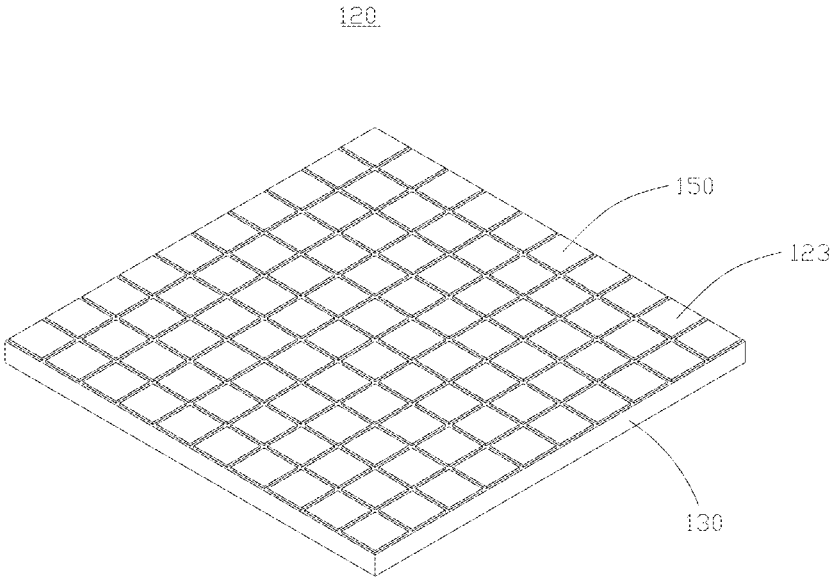
FIG. 6 is a schematic structural diagram illustrating a resonance structure according to embodiments.
Figure 7:
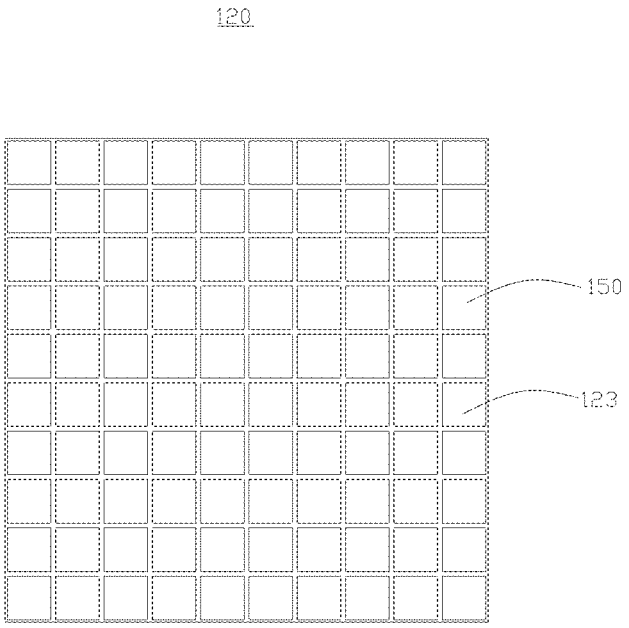
FIG. 7 is a schematic structural diagram illustrating the front of the resonance structure in FIG. 6.
Figure 8:
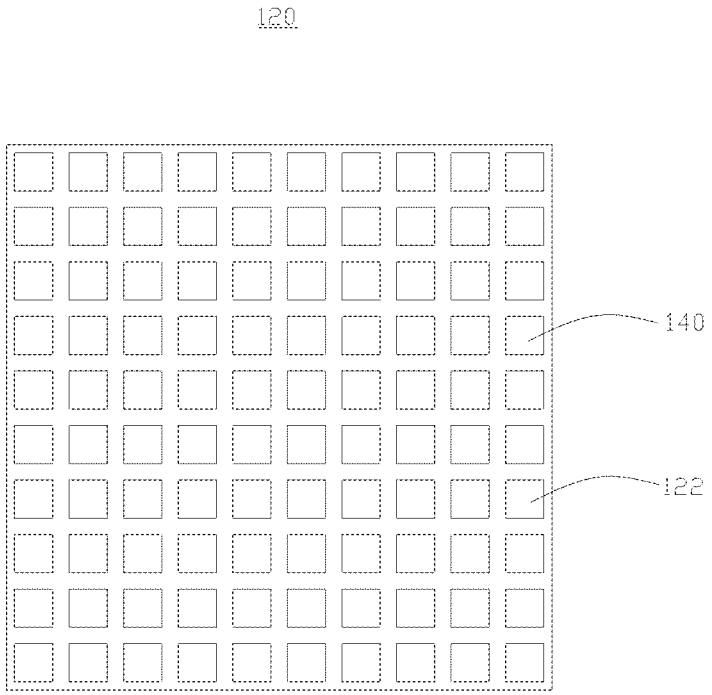
FIG. 8 is a schematic structural diagram illustrating the back of the resonance structure in FIG. 6.

Referring to FIG. 5, the antenna module 200 can transmit radio frequency signal beams in different directions. The resonance structure 120 can include multiple resonance units 121 arranged in array, and each of the multiple resonance units 121 may be orthogonal to a corresponding radio frequency signal beam (the dotted box in FIG. 5). That is, each resonance unit 121 can vertically pass through the center of the radio frequency signal beam. The antenna radome 100 can be designed as having a curved surface or an arc surface to cover the antenna module 200.

The radio frequency signal can penetrate the dielectric substrate 110 and the resonance structure 120. The radio frequency signal can be a millimeter wave signal, or a radio frequency signal in sub-6 GHz or in terahertz frequency band. The antenna module 200 can be a millimeter wave antenna or a sub-6 GHz antenna.

According to the specification of the 3GPP TS 38.101, two frequency ranges are mainly used in 5G: frequency range (FR)1 and FR2. The frequency range corresponding to FR1 is 450 MHz~6 GHz, also known as the sub-6 GHz; the frequency range corresponding to FR2 is 24.25 GHz~52.6 GHz, usually called millimeter wave (mm Wave). 3GPP (version 15) specifies the present 5G millimeter wave as follows: n257 (26.5~29.5 GHz), n258 (24.25~27.5 GHz), n261 (27.5~28.35 GHz), and n260 (37~40 GHz).

Figure 9:
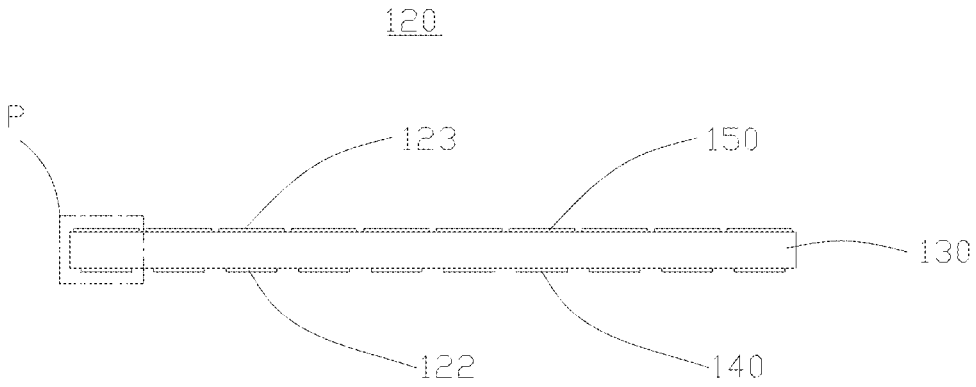
FIG. 9 is a schematic structural diagram illustrating a side of the resonance structure in FIG. 6.
Figure 10:
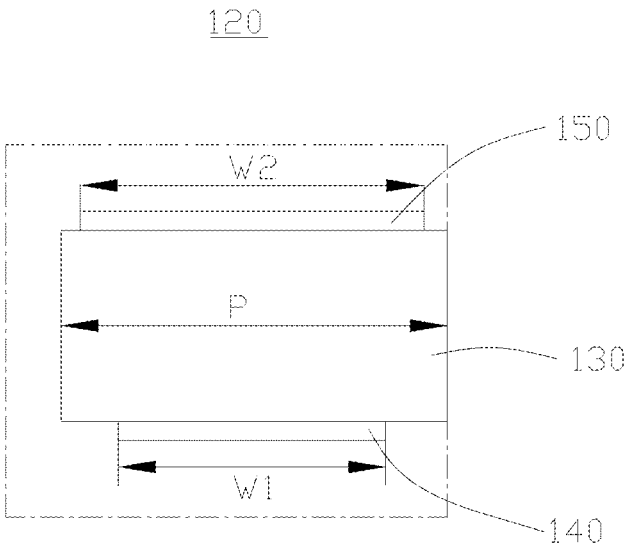
FIG. 10 is an enlarged view of area P of the resonance structure in FIG. 9.

Referring to FIG. 6, FIG. 7, FIG. 8, FIG. 9, and FIG. 10, the resonance structure 120 includes a first resonance layer 140 and a second resonance layer 150. The first resonance layer 140 has multiple first resonance units 122 arranged at regular intervals. The second resonance layer 150 has multiple second resonance units 123 arranged at regular intervals. Area P (the dotted box) of the resonance structure 120 is illustrated in FIG. 9 and an enlarged view of area P is illustrated in FIG. 10. The first resonance unit 122 has a side length of W1 and the second resonance unit 123 has a side length of W2, where $W1 \leq W2 < P$ and P is a period of arrangement of the first resonance unit 122 and the second resonance unit 123.

The first resonance unit 122 can have various shapes, including but not limited to, a square, a rectangle, a circle, a cross, a quincunx, or a hexagon, or the above shape can define a through hole. Similarly, the second resonance unit 123 can have various shapes, including but not limited to, a square, a rectangle, a circle, a cross, a quincunx, or a hexagon, or the above shape can define a through hole.

Furthermore, the resonance structure 120 and the dielectric substrate 110 may be stacked, and the resonance structure 120 can further include a carrier film layer 130. The first resonance layer 140 and the second resonance layer 150 may be respectively located on both sides of the carrier film layer 130, and the first resonance layer 140 disposed adjacent to the dielectric substrate 110 relative to the second resonance layer 150.

In an example, the first resonance layer 140 is located between the dielectric substrate 110 and the carrier film layer 130, and the second resonance layer 150 is located on a side of the carrier film layer 130 away from the first resonance layer 140. The second resonance layer 150 faces the antenna module 200. The first resonance layer 140 and the second resonance layer 150 cooperate with one another to have the in-phase reflection characteristic for the radio frequency signal of the preset frequency band, such that the distance between the radiation surface of the antenna module 200 and a surface of the second resonance layer 150 facing the antenna module 200 is less than or equal to a preset distance.

Figure 11:
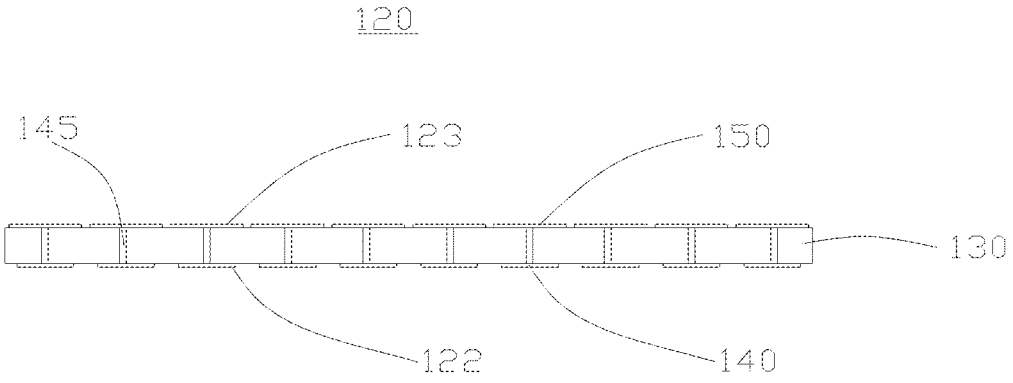
FIG. 11 is a schematic structural diagram illustrating another side of the resonance structure in FIG. 6.

Referring to FIG. 11, at least part of the multiple first resonance units 122 of the first resonance layer 140 are electrically connected with at least part of the multiple second resonance units 123 of the second resonance layer 150 through vias 145. The via 145 is a plated via, which can facilitate the packaging protection of the first resonance layer 140 and the second resonance layer 150 and can increase the stability of the first resonance layer 140 and the second resonance layer 150.

In an example, the first resonance units 122 can be in one-to-one correspondence with the second resonance units 123, that is, one first resonance unit 122 can be electrically connected with one second resonance unit 123 through one via 145. This configuration can improve the stability of the structure of the first resonance layer 140 and the second resonance layer 150, as well as improve ease of packaging the first resonance layer 140 and the second resonance layer 150.

Figure 12:
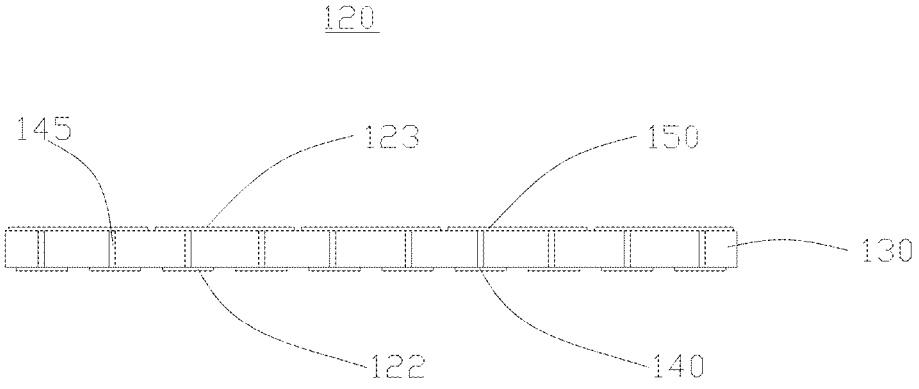
FIG. 12 is a schematic structural diagram illustrating still another side of the resonance structure in FIG. 6.

FIG. 12 depicts another example where more than one first resonance unit 122 is connected with one second resonance unit 123. More specifically, more than one first resonance unit 122 is electrically connected with one second resonance unit 123 through vias 145. Since the area of the first resonance unit 122 is smaller than the area of the second resonance unit 123, connecting more than one first resonance unit 122 to one second resonance unit 123 at the same time can improve the reliability of the electrical connection between the first resonance units 122 and the second resonance units 123. For example, when an electrical connection path between a first resonance unit 122 and one second resonance unit 123 is disconnected, another electrical connection path between another first resonance unit 122 and the one second resonance unit 123 can provide a normal electrical connection. This can avoid electrical connection failure between the first resonance units 122 and the second resonance units 123.

Figure 13:
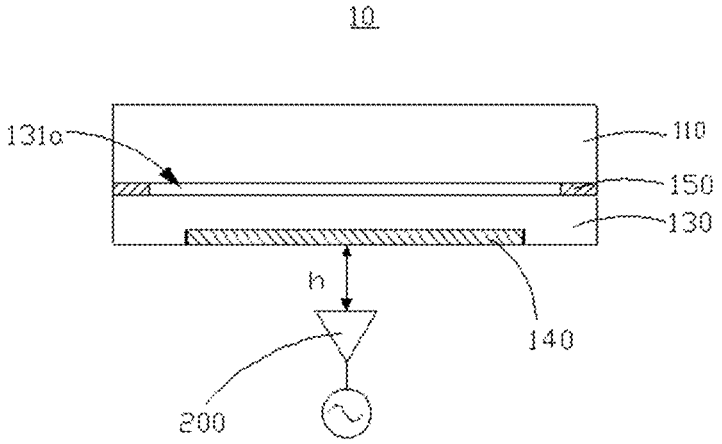
FIG. 13 is a schematic structural diagram illustrating an antenna device according to other embodiments.

FIG. 13 depicts an example where the projection of the first resonance layer 140 on the carrier film layer 130 and the projection of the second resonance layer 150 on the carrier film layer 130 do not, at least in part, overlap. That is, the first resonance layer 140 and the second resonance layer 150 can be completely misaligned in a thickness direction. Alternatively, the first resonance layer 140 and the second resonance layer 150 may be partially misaligned in the thickness direction. As such, the mutual interference between the first resonance layer 140 and the second resonance layer 150 can be reduced, which can improve stability of the radio frequency signal passing through the dielectric substrate 110.

The second resonance layer 150 can have a through hole 131*a*, and the projection of the first resonance layer 140 on the second resonance layer 150 is located in the through hole 131*a*.

The through hole 131*a* can have various shapes, including but not limited to, a circle, an ellipse, a square, a triangle, a rectangle, a hexagon, a ring, a cross, and a Jerusalem cross.

In this example, the second resonance layer 150 can have a through hole 131*a*, the size of the through hole 131*a* can be larger than the size of the perimeter of the first resonance layer 140, and the projection of the first resonance layer 140 on the second resonance layer 150 can be disposed entirely within the through hole 131*a*. The radio frequency signal of the preset frequency band can be transmitted through the through hole 131*a* of the second resonance layer 150 after being subjected to the resonance effect of the first resonance layer 140, thereby reducing interference of the second resonance layer 150 on the first resonance layer 140. In this way, stability of the radio frequency signal transmission can be improved.

Figure 14:
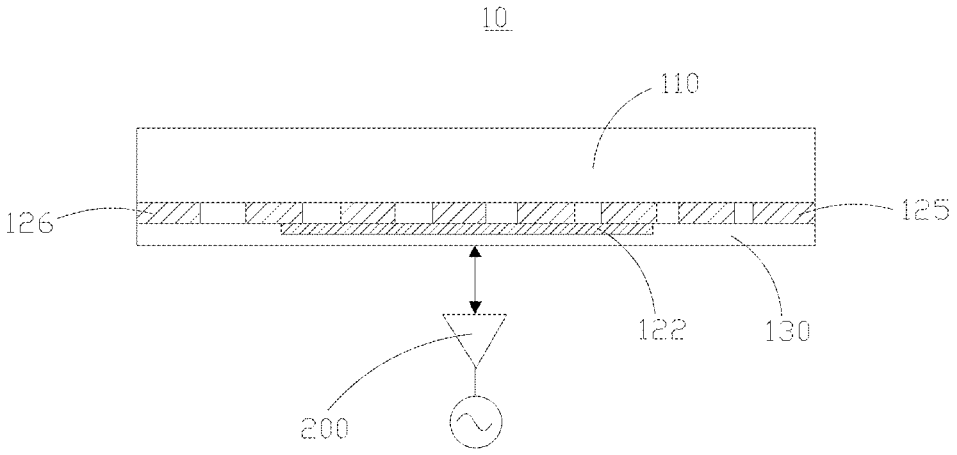
FIG. 14 is a schematic structural diagram illustrating an antenna device according to other embodiments.
Figure 15:
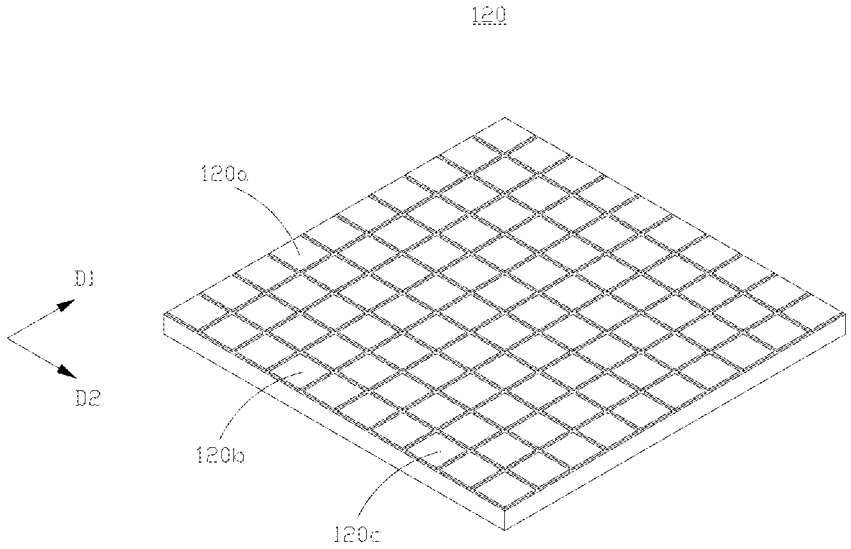
FIG. 15 is a schematic structural diagram illustrating a resonance structure according to embodiments.
Figure 16:
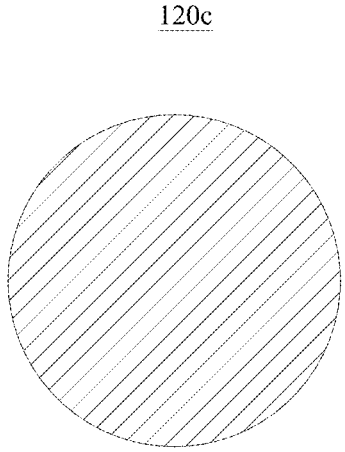
FIG. 16 is a schematic structural diagram illustrating a grid structure according to embodiments.
Figure 17:
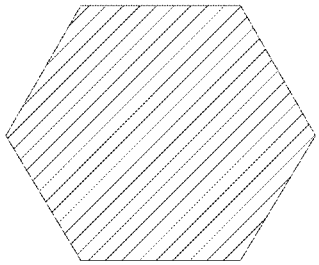
FIG. 17 is a schematic structural diagram illustrating a grid structure according to other embodiments.
Figure 18:
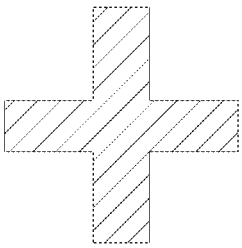
FIG. 18 is a schematic structural diagram illustrating a grid structure according to other embodiments.
Figure 19:
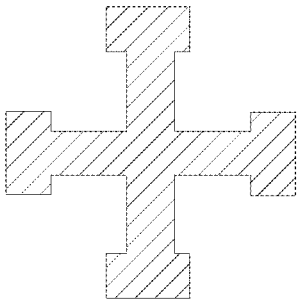
FIG. 19 is a schematic structural diagram illustrating a grid structure according to other embodiments.
Figure 20:
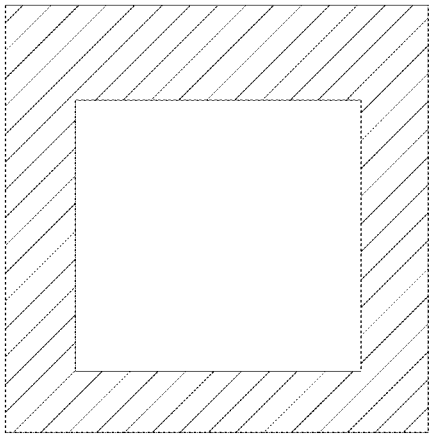
FIG. 20 is a schematic structural diagram illustrating a grid structure according to other embodiments.
Figure 21:
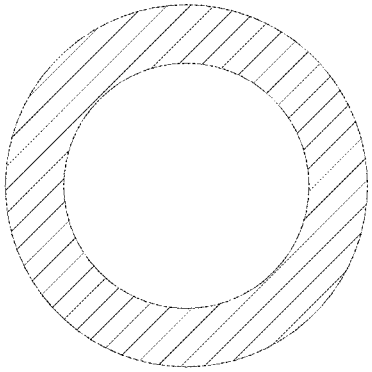
FIG. 21 is a schematic structural diagram illustrating a grid structure according to other embodiments.
Figure 22:
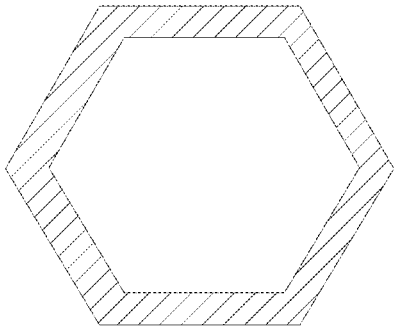
FIG. 22 is a schematic structural diagram illustrating a grid structure according to other embodiments.
Figure 23:
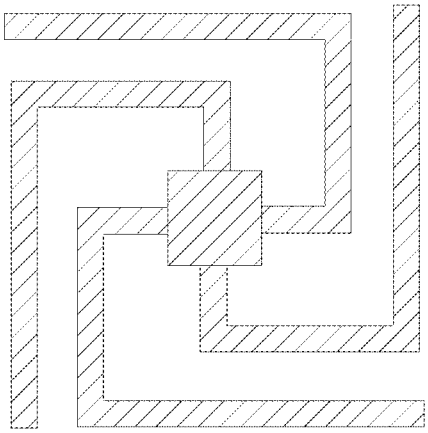
FIG. 23 is a schematic structural diagram illustrating a grid structure according to other embodiments.

Referring to FIG. 14, an adhesive member 125 can be provided between the dielectric substrate 110 and the carrier film layer 130, and the adhesive member 125 may fixedly connect the dielectric substrate 110 to the carrier film layer 130.

The adhesive member 125 can be a gel, for example, an optical adhesive or a double-sided adhesive.

In one example, the adhesive member 125 is an integral layer of double-sided adhesive, i.e., the double-sided adhesive is a whole piece, and is used to fixedly connect the dielectric substrate 110 and the carrier film layer 130, such that the dielectric substrate 110 and the carrier film layer 130 are closely adhered to each other. This structure can help reduce interference to the radio frequency signal generated by the antenna module 200, for example, caused by an air medium between the dielectric substrate 110 and the carrier film layer 130.

In another example, the adhesive member 125 includes several colloidal units 126 arranged at intervals. The colloidal units 126 arranged at intervals can be arranged in array. The carrier film layer 130 is adhered to the dielectric substrate 110 by using several colloidal units 126 arranged at regular intervals. Since there is no direct contact between adjacent colloidal units 126, the internal stress generated between the adjacent colloidal units 126 can be reduced or eliminated, further reducing or eliminating the internal stress between the carrier film layer 130 and the dielectric substrate 110. Reducing the concentration of stresses (or stress concentration) between the carrier film layer 130 and the dielectric substrate 110, the service life of the dielectric substrate 110 may be extended.

Furthermore, adjacent colloidal units 126, which are disposed corresponding to the edge of the dielectric substrate 110, can be spaced apart from one another at a first spacing. Adjacent colloidal units 126, which are disposed corresponding to the middle of the dielectric substrate 110, can be apart from one another at a second spacing. The first spacing can be larger than the second spacing. Stress concentration can be higher and/or more likely to be present when the edge of the dielectric substrate 110 is bonded to the carrier film layer 130. Therefore, when the first spacing between the adjacent colloidal units 126 (corresponding to the edge of the dielectric substrate 110) is larger than the second spacing between the adjacent colloidal units 126 (corresponding to the middle of the dielectric substrate 110), stress concentration between the colloidal units 126 disposed at the edge of the dielectric substrate 110 can be reduced, and the stress concentration when the edge of the dielectric substrate 110 is bonded to the carrier film layer 130 can be further improved.

Referring to FIGS. 15 to 23, the resonance structure 120 can be made of metal conductive material or transparent conductive material. The resonance structure 120 includes conductive lines 120*a* arranged at intervals in a first direction D1 and conductive lines 120*b* arranged at intervals in a second direction D2. The conductive lines 120*a* arranged at intervals in the first direction D1 and the conductive lines 120*b* arranged at intervals in the second direction D2 cross with one another to form multiple grid structures 120*c* arranged in array.

The first direction D1 can be orthogonal to the second direction D2, or the first direction D1 can form an acute angle or an obtuse angle with the second direction D2. The conductive lines 120*a* spaced apart in the first direction D1 and the conductive lines 120*b* spaced apart in the second direction D2 cross each other to form the multiple grid structures 120*c* arranged in array.

Furthermore, the resonance structure 120 can include multiple grid structures 120*c* arranged in array, where each of the multiple grid structures 120*c* is surrounded by at least one conductive line, and two adjacent grid structures 120*c* at least share part of the at least one conductive line.

In an example, the grid structure 120*c* is a closed structure surrounded by the at least one conductive line, for example, a honeycomb hexagonal array structure, and two adjacent grid structures 120*c* share part of the at least one conductive line.

Figure 24:
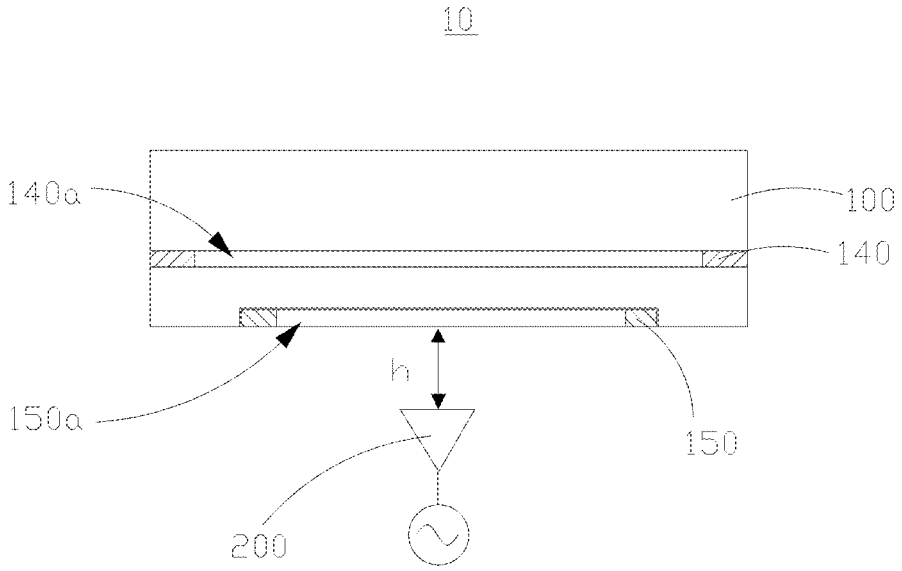
FIG. 24 is a schematic structural diagram illustrating an antenna device according to other embodiments.

Referring to FIG. 24, the first resonance layer 140 has a first through hole 140*a*, and the second resonance layer 150 has a second through hole 150*a*. When both the first resonance layer 140 and the second resonance layer 150 are within a preset direction range of receiving/transmitting a radio frequency signal by the antenna module 200 and the first through hole 140*a* is different from the second through hole 150*a* in size, the bandwidth of the radio frequency signal transmitted by the antenna module 200 after passing through the first through hole 140*a* is different from the bandwidth of the radio frequency signal transmitted by the antenna module 200 after passing through the second through hole 150*a*.

In an example, when the radial size of the first through hole 140*a* is greater than the radial size of the second through hole 150*a*, the bandwidth of the radio frequency signal emitted by the antenna module 200 after passing through the first through hole 140*a* can be greater than the bandwidth of the radio frequency signal emitted by the antenna module 200 after passing through the second through hole 150*a*. In other words, the bandwidth of the radio frequency signal after passing through the first through hole 140*a* or the second through hole 150*a* may be positively related to the radial size of the first through hole 140*a* or the second through hole 150*a*. When the radial size of the first through hole 140*a* is greater than the radial size of the second through hole 150*a*, the bandwidth of the radio frequency signal after passing through the first through hole 140*a* is greater than the bandwidth of the radio frequency signal after passing through the second through hole 150*a*. Thus, by controlling the radial size of the first through hole 140*a* of the first resonance layer 140 and the radial size of the second through hole 150*a* of the second resonance layer 150, the bandwidth of the radio frequency signal can be adjusted, which can make the radio frequency signal cover various, or all, 5G bands.

Figure 25:
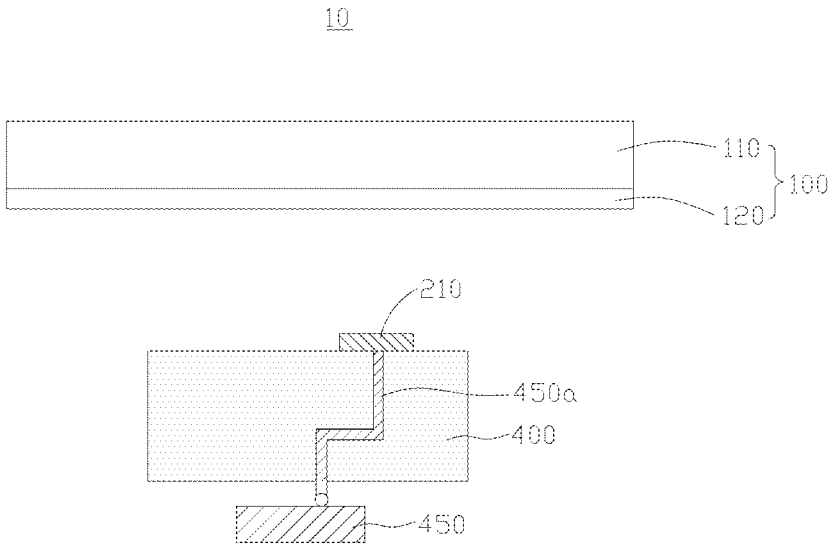
FIG. 25 is a schematic structural diagram illustrating an antenna device according to other embodiments.
Figure 26:
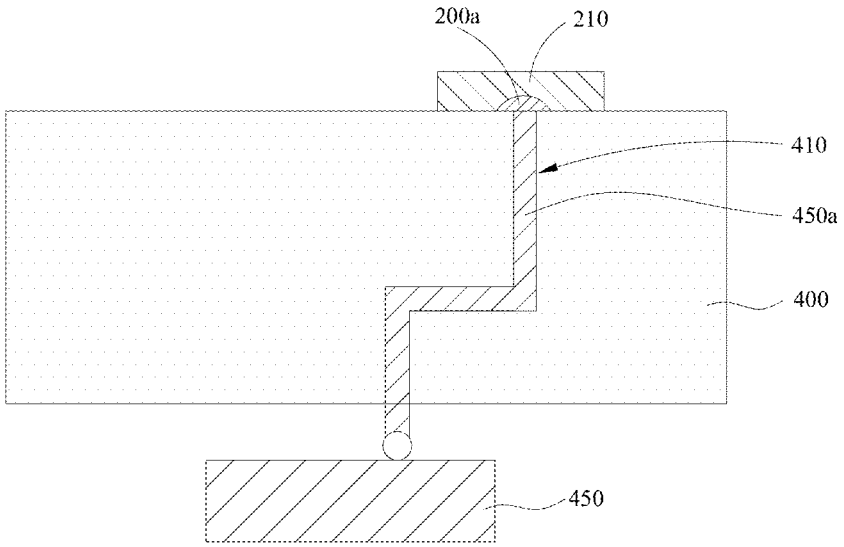
FIG. 26 is a schematic structural diagram illustrating part of an antenna device according to embodiments.

Referring to FIGS. 25 and 26, the antenna module 200 includes a substrate 400 and a radio frequency chip 450. The antenna radiating body 210 of the antenna module 200 is located on a side (or surface) of the substrate 400 adjacent to the resonance structure 120. The radio frequency chip 450 is located on a side (or surface) of the substrate 400 away from the resonance structure 120. The antenna module 200 further includes a radio frequency line 450*a*, and the radio frequency line 450*a* is used to electrically connect the radio frequency chip 450 and the antenna radiating body 210 of the antenna module 200.

The substrate 400 can be prepared by performing a high density inverter (HDI) process on a multilayer printed circuit board (PCB). The radio frequency chip 450 is located on a side of the substrate 400 away from the antenna radiating body 210 of the antenna module 200. The antenna radiating body 210 of the antenna module 200 has at least one feed point 200*a*. The feed point 200*a* is used to receive a current signal from the radio frequency chip 450, and further make the antenna radiating body 210 of the antenna module 200 resonate, generating radio frequency signals in different frequency bands.

Additionally, positioning the antenna radiating body 210 of the antenna module 200 on the surface of the substrate 400 adjacent to the resonance structure 120 can make the radio frequency signal generated by the antenna module 200 transmit towards the resonance structure 120.

The substrate 400 has a limiting hole 410. The radio frequency line 450*a* is received in the limiting hole 410. The radio frequency line 450*a* can have one end electrically connected with the antenna radiating body 210 of the antenna module 200 and the other end electrically connected with the radio frequency chip 450. The current signal generated by the radio frequency chip 450 is transmitted to the antenna radiating body 210 of the antenna module 200 through the radio frequency line 450*a*.

In order to electrically connect the radio frequency chip 450 and the antenna radiating body 210 of the antenna module 200, the limiting hole 410 needs to be provided on the substrate 400. The radio frequency wire 450*a* is disposed in the limiting hole 410 to electrically connect the antenna radiating body 210 of the antenna module 200 and the radio frequency chip 450. Therefore, the current signal on the radio frequency chip 450 is transmitted to the antenna radiating body 210 of the antenna module 200, and then the antenna radiating body 210 of the antenna module 200 generates the radio frequency signal according to the current signal.

Figure 27:
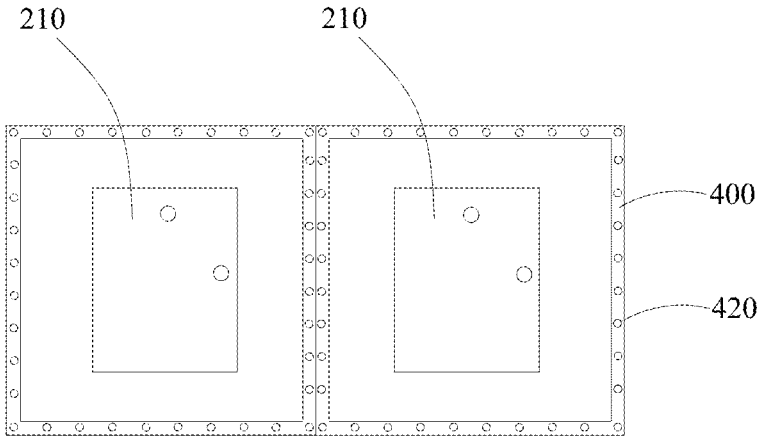
FIG. 27 is a top view of part of the antenna device in FIG. 26.

Referring to FIG. 27, the substrate 400 has multiple plated vias 420. The multiple plated vias 420 are disposed around the antenna radiating body 210 to isolate two adjacent antenna radiating bodies 210. Among them, there are several uniformly arranged plated vias 420 on the substrate 400, which surround the antenna module 200. The plated vias 420 can be provided to achieve isolation and decoupling in the antenna module. That is, due to the presence of the plated vias 420, radiation interference between adjacent two antenna modules 200 due to mutual coupling can be prevented, and the antenna module 200 can be ensured to be in a stable working state.

Figure 28:
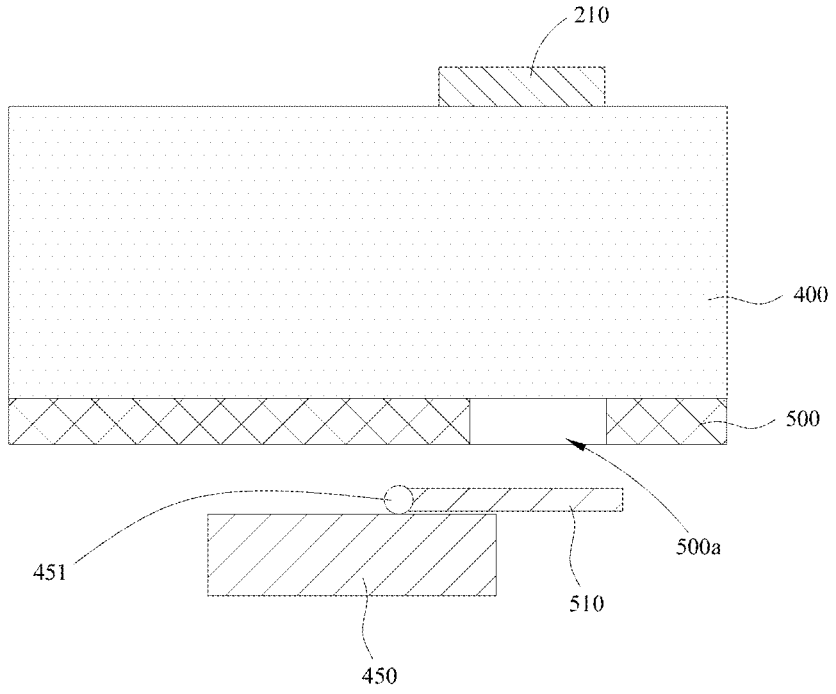
FIG. 28 is a schematic structural diagram illustrating part of an antenna device according to other embodiments.

Referring to FIG. 28, the antenna module 200 further includes a ground-fed layer 500. The antenna radiating body 210 is located on the surface of the substrate 400 adjacent to the resonance structure 120. The radio frequency chip 450 is located on the surface of the substrate 400 away from the resonance structure 120. The ground-fed layer 500 is located between the substrate 400 and the radio frequency chip 450. The ground-fed layer 500 serves as the ground electrode of the antenna radiating body 210. The ground-fed layer 500 has a gap 500*a*. A feed trace 510 is provided between the radio frequency chip 450 and the ground-fed layer 500. The feed trace 510 is electrically connected with the radio frequency chip 450. The projection of the feed trace 510 on the ground-fed layer 500 is at least partially within the gap 500*a*. The feed trace 510 performs coupling feed on the antenna radiating body 210 through the gap 500*a*.

The radio frequency chip 450 has an output end 451, where the output end 451 can be used to generate a current signal. The current signal generated by the radio frequency chip 450 is transmitted to the feed trace 510. The feed trace 510 is set corresponding to the gap 500*a* of the ground-fed layer 500. Thus, the feed trace 510 can transmit, through the gap 500*a*, the current signal received to the feed point 200*a* of the antenna radiating body 210 through coupling. The antenna module 200 is coupled to the current signal from the feed trace 510 to generate the radio frequency signal of the preset frequency band.

Furthermore, the ground-fed layer 500 constitutes the ground electrode of the antenna radiating body 210. The antenna radiating body 210 does not need to be electrically connected with the ground-fed layer 500 directly, but the antenna radiating body 210 is grounded by coupling. The projection of the feed trace 510 on the ground-fed layer 500 is at least partially within the gap 500*a*, so that the feed trace 510 can conduct coupling feed on the antenna radiating body 210 through the gap 500*a*.

Figure 29:
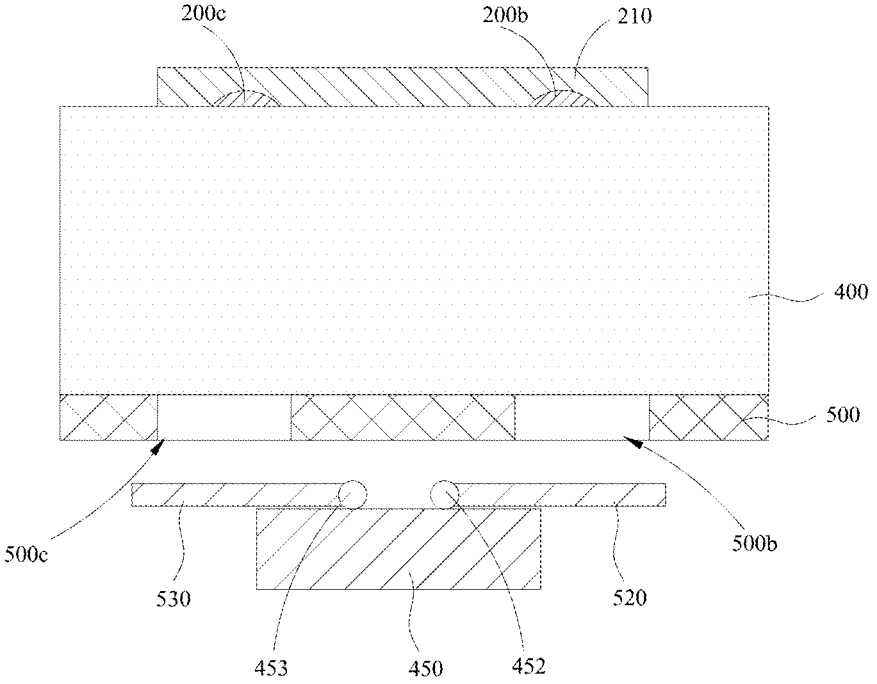
FIG. 29 is a schematic structural diagram illustrating part of an antenna device according to other embodiments.
Figure 30:
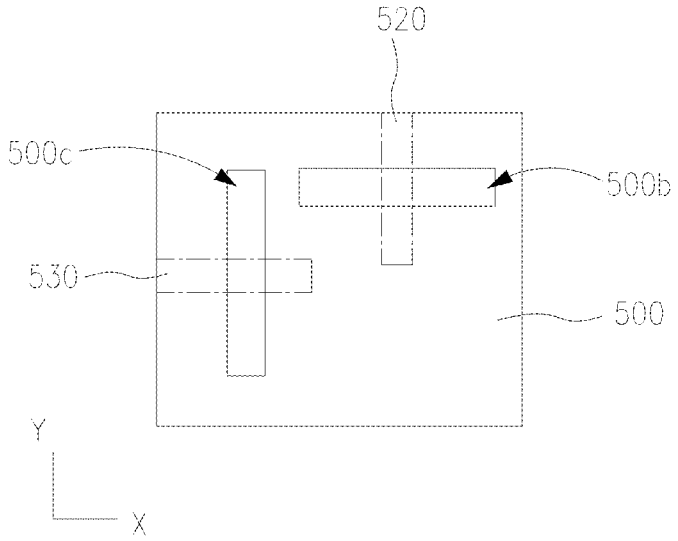
FIG. 30 is a schematic structural diagram illustrating a ground-fed layer of the antenna device in FIG. 29.

FIG. 29 and FIG. 30 depict other examples where the radio frequency chip 450 has a first output end 452 and a second output end 453. The first output end 452 is used to generate a first current signal. The second output end 453 is used to generate a second current signal. The first current signal generated by the radio frequency chip 450 is transmitted to a first sub feed trace 520. The first sub feed trace 520 is provided corresponding to the first gap 500*b* of the ground-fed layer 500. Thus, the first sub feed trace 520 can transmit, through the first gap 500*b*, the first current signal received to a first feed point 200*b* of the antenna radiating body 210 in a coupling manner. The antenna radiating body 210 is coupled to the first current signal from the first sub feed trace 520 to generate a radio frequency signal of a first frequency band. The second current signal generated by the radio frequency chip 450 is transmitted to a second sub feed trace 530. The second sub feed trace 530 is provided corresponding to the second gap 500*c* of the ground-fed layer 500. Thus, the second sub feed trace 530 can transmit through the second gap 500*c* the second current signal received to a second feed point 200*c* of the antenna radiating body 210 in a coupling manner. The antenna radiating body 210 is coupled to the second current signal from the second sub feed trace 530 to generate a radio frequency signal of a second frequency band. When the first current signal is different from the second current signal, the radio frequency signal of the first frequency band is also different from the radio frequency signal of the second frequency band. As a result, the antenna module can work in multiple frequency bands, widening the frequency range of the antenna module. In this way, the use range of the antenna module can be adjusted flexibly.

Furthermore, the ground-fed layer 500 constitutes the ground electrode of the antenna radiating body 210. The antenna radiating body 210 and the ground-fed layer 500 do not need to be electrically connected directly, but the antenna radiating body 210 is grounded by coupling. The projection of the first sub feed trace 520 on the ground-fed layer 500 is at least partially within the first gap 500*b*, and the projection of the second sub feed trace 530 on the ground-fed layer 500 is at least partially within the second gap 500*c*. It is convenient for the first sub feed trace 520 to conduct coupling feed on the antenna radiating body 210 through the first gap 500*b* and for the second sub feed trace 530 to conduct coupling feed on the antenna radiating body 210 through the second gap 500*c*.

Furthermore, in an example, the first gap 500*b* extends in a first direction and the second gap 500*c* extends in a second direction, where the first direction is perpendicular to the second direction.

In an example, both the first gap 500*b* and the second gap 500*c* can be strip gaps. The first gap 500*b* can be a vertical polarized gap or a horizontal polarized gap, and the second gap 500*c* can be a vertical polarized gap or a horizontal polarized gap. When the first gap 500*b* is a vertical polarized gap, the second gap 500*c* is a horizontal polarized gap. When the first gap 500*b* is a horizontal polarized gap, the second gap 500*c* is a vertical polarized gap. This application uses the example in which an extending direction of the first gap 500*b* is the Y direction and an extending direction of the second gap 500*c* is the X direction. When the extending direction of the first gap 500*b* is perpendicular to the extending direction of the second gap 500*c*, the ground-fed layer 500 is the ground-fed layer 500 with a bipolar (or a dual-polarized) gap 500*a*. In this case, the antenna module is a bipolar antenna module. Thus, the radiation direction of the antenna module can be adjusted, which in turn can achieve targeted radiation, increasing the gain of radiation of the antenna module. The "polarization of the antenna" may refer to a direction of the electric field strength in which the antenna radiates an electromagnetic wave. When the direction of the electric field strength is perpendicular to the ground, this electromagnetic wave is called a vertical polarized wave; and when the direction of the electric field strength is parallel to the ground, this electromagnetic wave is called a horizontal polarized wave. Due to the characteristics of the radio frequency signal, a signal propagated through horizontal polarization manner will produce a polarization current on the ground surface when the signal is close to the ground. The polarization current generates thermal energy influenced by the earth impedance, which causes the electric field signal to decay rapidly. With the vertical polarization manner, significant effort is required to produce the polarization current, avoiding rapid attenuation of energy and ensuring the effective propagation of the signal. Therefore, in the mobile communication system, the vertical polarized propagation manner is generally adopted. The bipolar antenna generally can have two configurations: vertical and horizontal polarization and ±45° polarization, and the latter can generally be superior to the former in performance. Thus, ±45° polarization is more widely adopted. The bipolar antenna combines +45° and −45° antennas with mutually orthogonal polarization directions, and works simultaneously in a duplex mode (for example, a receive/transmit mode), which can save the number of antennas in each cell. Moreover, because ±45° are orthogonal polarization directions, the positive effects of diversity reception can be provided (e.g. its polarization diversity gain can be about 5d, which may be about 2d higher than that of a single-polarized antenna).

Furthermore, the extending direction of the first gap 500*b* is perpendicular to an extending direction of the first sub feed trace 520, and the extending direction of the second gap 500*c* is perpendicular to an extending direction of the second sub feed trace 530.

In this example, the first gap 500*b* and the second gap 500*c* are strip gaps. The first sub feed trace 520 and the ground-fed layer 500 are spaced apart. The second sub feed trace 530 and the ground-fed layer 500 are spaced apart. The projection of the first sub feed trace 520 on the ground-fed layer 500 is at least partially within the first gap 500*b*. The projection of the second sub feed trace 530 on the ground-fed layer 500 is at least partially within the second gap 500*c*. The extending direction of the first sub feed trace 520 is perpendicular to the extending direction of the first gap 500*b*, and the extending direction of the second sub feed trace 530 is perpendicular to the extending direction of the second gap 500*c*. In this way, the coupling feed effect of the dual-polarized antenna module can be improved, thereby improving the radiation efficiency of the antenna module and improving the radiation gain.

Figure 31:
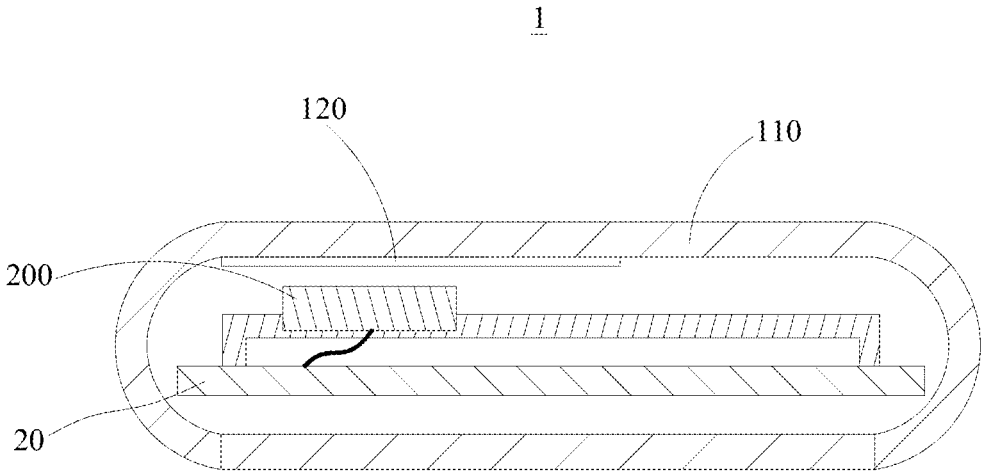
FIG. 31 is a schematic structural diagram illustrating an electronic device according to embodiments.

Referring to FIG. 31, the electronic device 1 includes a main board 20 and the antenna device 10 of any of the above embodiments, where the antenna module 200 is electrically coupled with the main board 20 and is configured to receive/transmit a radio frequency signal through the antenna radome 100 under control of the main board 20.

The electronic device 1 can be any device with communication and storage functions, for example, tablet computers, mobile phones, e-readers, remote controllers, personal computers (PC), notebook computers, in-vehicle devices, network TVs, wearable devices, and other smart devices with network functions.

The main board 20 can be a PCB of the electronic device 1. The main board 20 and the dielectric substrate 110 define a receiving space. The antenna module 200 is located in the receiving space and the antenna module 200 is electrically connected with the main board 20. Under the control of the main board 20, the antenna module 200 can send and receive a radio frequency signal through the antenna radome 100.

The antenna module 200 is spaced apart from the resonance structure 120. The antenna module 200 includes at least one antenna radiating body 210. The resonance structure 120 is at least partially within the preset direction range of receiving/transmitting a radio frequency signal by the antenna module 200, so as to match the frequency of the radio frequency signal received/transmitted by the antenna module 200.

In this example, the antenna module 200 is spaced apart from the resonance structure 120, and the antenna module 200 is located on the side of the resonance structure 120 away from the dielectric substrate 110. The at least one antenna radiating body 210 can form a 2×2 antenna array, a 2×4 antenna array, or a 4×4 antenna array. In the case that the at least one antenna radiating body 210 forms an antenna array, the at least one antenna radiating body 210 can work in the same frequency band. The at least one antenna radiating body 210 can also work in different frequency bands, which helps to expand the frequency range of antenna module 200.

Figure 32:
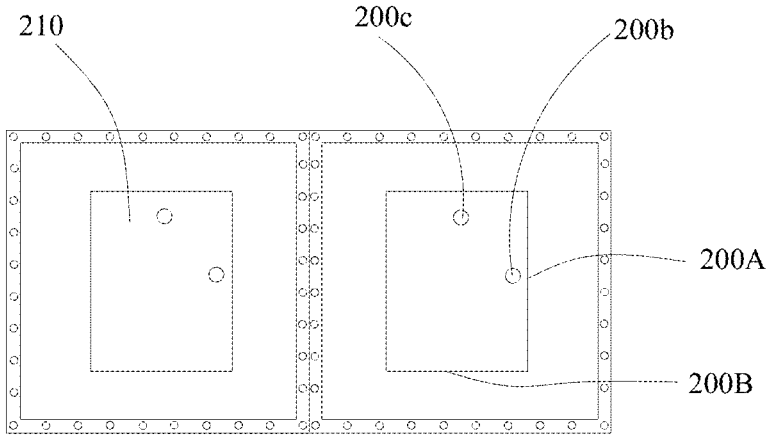
FIG. 32 is a top view of an antenna module of the electronic device in FIG. 31.

Referring to FIG. 32, the antenna radiating body 210 has the first feed point 200*b* and the second feed point 200*c*. The first feed point 200*b* is used to feed the first current signal to the antenna radiating body 210. The first current signal is used to excite the antenna radiating body 210 to resonate in the first frequency band, to receive/transmit the radio frequency signal of the first frequency band. The second feed point 200*c* is used to feed the second current signal to the antenna radiating body 210. The second current signal is used to excite the antenna radiating body 210 to resonate in the second frequency band. The first frequency band is different from the second frequency band.

The first frequency band can be a high-frequency signal, and the second frequency band can be a low-frequency signal. Alternatively, the first frequency band can be a low-frequency signal, and the second frequency band can be a high-frequency signal.

According to the specification of the 3GPP TS 38.101, two frequency ranges are mainly used in 5G: FR1 and FR2. The frequency range corresponding to FR1 is 450 MHz~6 GHz, also known as the sub-6 GHz; the frequency range corresponding to FR2 is 24.25 GHz~52.6 GHz, usually called millimeter wave (mm Wave). 3GPP (version 15) specifies the present 5G millimeter wave as follows: n257 (26.5~29.5 GHz), n258 (24.25~27.5 GHz), n261 (27.5~28.35 GHz), and n260 (37~40 GHz). The first frequency band can be a frequency range of millimeter wave, and meanwhile the second frequency band can be a sub-6 GHz.

In an example, the antenna radiating body 210 can be a rectangular patch antenna, with a long side 200A and a short side 200B. The long side 200A of the antenna radiating body 210 is provided with the first feed point 200*b*, for receiving/transmitting the radio frequency signal of the first frequency band. The radio frequency signal of the first frequency band is a low frequency signal. The short side 200B of the antenna radiating body 210 is provided with the second feed point 200*c*, for receiving/transmitting the radio frequency signal of the second frequency band. The radio frequency signal of the second frequency band is a high frequency signal. The long side 200A and the short side 200B of the antenna radiating body 210 are used to change the electrical length of the antenna radiating body 210, thereby changing the frequency of the radio frequency signal radiated by the antenna module 200.

Figure 33:
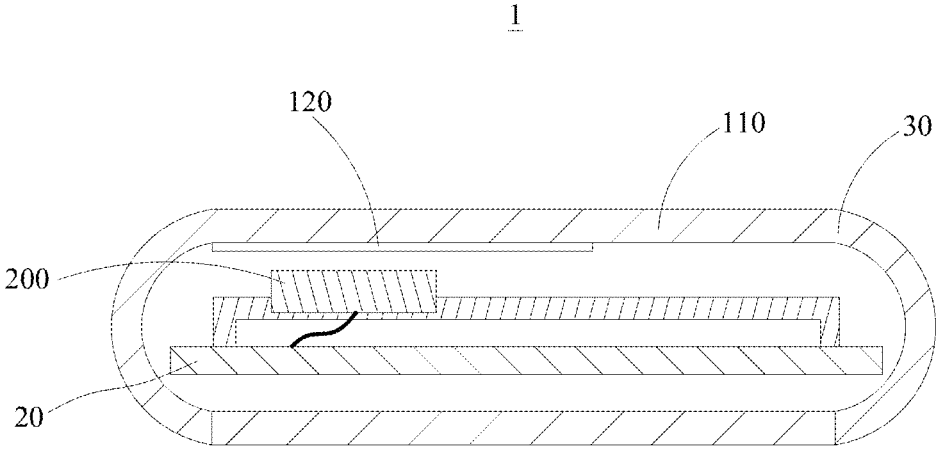
FIG. 33 is a schematic structural diagram illustrating an electronic device according to other embodiments.

Referring to FIG. 33, the electronic device 1 further includes a battery cover 30. The battery cover 30 serves as the dielectric substrate 110 and the battery cover 30 can be made of any one or more of plastic, glass, sapphire, and ceramic.

In detail, in the structural arrangement of the electronic device 1, at least a part of the battery cover 30 is located in a preset direction range of receiving/transmitting a radio frequency signal by the antenna module 200. Therefore, the battery cover 30 will also affect the radiation characteristics of antenna module 200. As such, in this embodiment, using the battery cover 30 as the dielectric substrate 110 can make the antenna module 200 have stable radiation performance in the structural arrangement of the electronic device 1.

Figure 34:
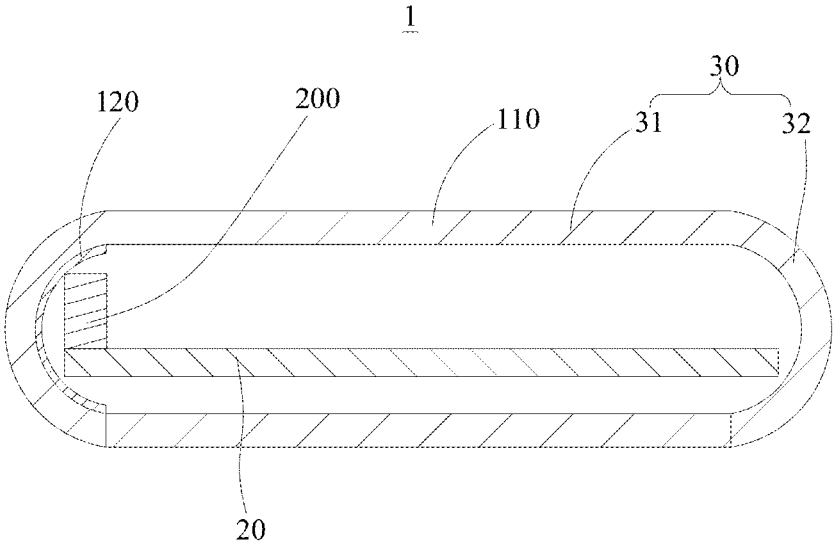
FIG. 34 is a schematic structural diagram illustrating an electronic device according to other embodiments.

Referring to FIG. 34, the battery cover 30 includes a back plate 31 and a side plate 32 surrounding the back plate 31. When the side plate 32 is located in a preset direction range for receiving/transmitting a radio frequency signal by the antenna module 200 and the resonance structure 120 is located on a side of the side plate 32 facing the antenna module 200, the side plate 32 serves as the dielectric substrate 110.

In detail, when the antenna module 200 faces the side plate 32 of the battery cover 30, the side plate 32 can be used to perform spatial impedance matching on the radio frequency signal received/transmitted by the antenna module 200. In this case, the side plate 32 is used as the dielectric substrate 110 to perform spatial impedance matching on the antenna module 200, which takes the arrangement of the antenna module 200 in the entire electronic device 1 into consideration. In this way, the radiation effect of the antenna module 200 in the entire electronic device can be ensured.

Figure 35:
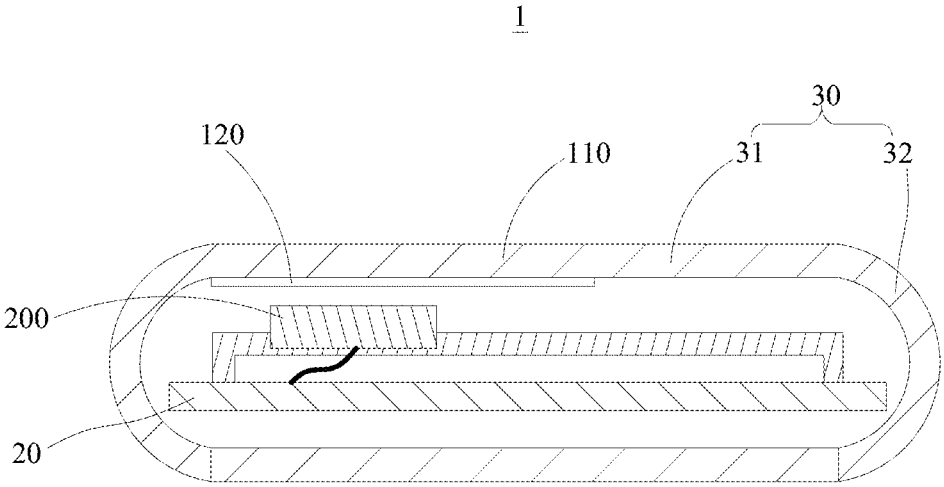
FIG. 35 is a schematic structural diagram illustrating an electronic device according to other embodiments.

Referring to FIG. 35, the battery cover 30 includes a back plate 31 and a side plate 32 surrounding the back plate 31. When the back plate 31 is located in a preset direction range for receiving/transmitting a radio frequency signal by the antenna module 200 and the resonance structure 120 is located on a side of the back plate 31 facing the antenna module 200, the back plate 31 serves as the dielectric substrate 110.

In detail, when the antenna module 200 faces the back plate 31 of the battery cover 30, the back plate 31 can be used to perform spatial impedance matching on the radio frequency signal received/transmitted by the antenna module 200. In this case, the back plate 31 is used as the dielectric substrate 110 to perform spatial impedance matching on the antenna module 200, which takes the arrangement of the antenna module 200 in the entire electronic device 1 into account. In this way, the radiation effect of the antenna module 200 in the entire electronic device can be ensured.

Figure 36:
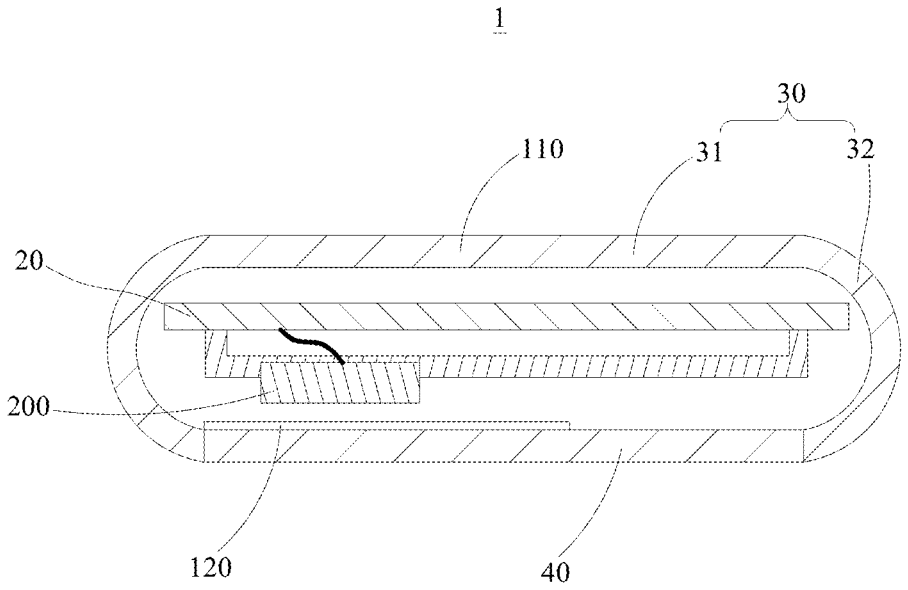
FIG. 36 is a schematic structural diagram illustrating an electronic device according to other embodiments.

Referring to FIG. 36, the electronic device 1 includes a screen 40 and the screen 40 serves as the dielectric substrate 110.

In detail, when the antenna module 200 faces the screen 40, the screen 40 can be used to perform spatial impedance matching on the radio frequency signal received/transmitted by the antenna module 200. In this case, the screen 40 can be used as the dielectric substrate 110 to perform spatial impedance matching on the antenna module 200, which takes the arrangement of the antenna module 200 in the entire electronic device 1 into consideration. Consequently, the radiation effect of the antenna module 200 in the entire electronic device can be ensured.

Figure 37:
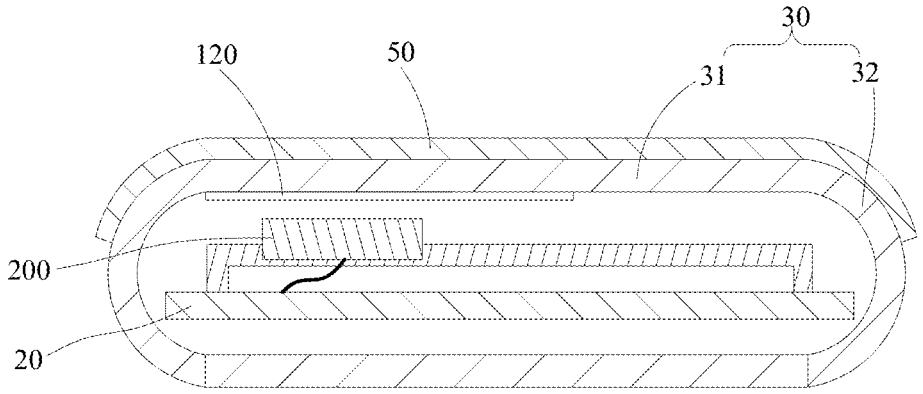
FIG. 37 is a schematic structural diagram illustrating an electronic device when a protective cover is applied to the electronic device according to embodiments.

Referring to FIG. 37, the electronic device 1 further includes a protective cover 50, and when the protective cover 50 is located in a preset direction range for receiving/transmitting a radio frequency signal by the antenna module 200, the protective cover 50 serves as the dielectric substrate 110.

In detail, when the antenna module 200 faces the protective cover 50, the protective cover 50 can be used to perform spatial impedance matching on the radio frequency signal received/transmitted by the antenna module 200. In this case, the protective cover 50 is used as the dielectric substrate 110 to perform spatial impedance matching on the antenna module 200, which considers the arrangement of the antenna module 200 in the entire electronic device 1. In this way, the radiation effect of the antenna module 200 in the entire electronic device can be ensured.

Figure 38:
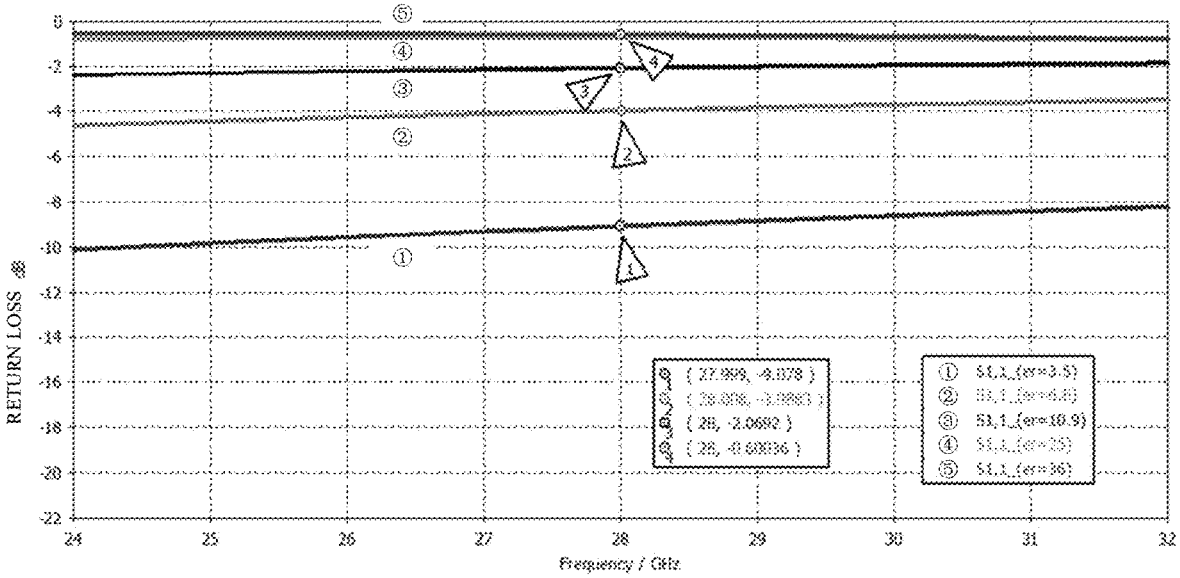
FIG. 38 is a schematic diagram of curves of a reflection coefficient of an antenna radome with a thickness of 0.55 mm in terms of different dielectric constants.

FIG. 38 is a schematic diagram of curves of a reflection coefficient of an antenna radome with a thickness of 0.55 mm in terms of different dielectric constants. Taking the 28 GHz antenna module as an example, the antenna module is a simple square patch antenna, with a side length of 3.22 mm, the dielectric substrate is Rogers 5880 sheet, with a thickness of 0.381 mm, and the size of the main board is L=20 mm. In FIG. 38, the abscissa denotes the frequency, unit: GHz and the ordinate denotes the return loss, unit: dB. Curve ① indicates a curve of a reflection coefficient of the antenna radome with an effective dielectric constant of 3.5 and the thickness of 0.55 mm. Curve ② indicates a curve of a reflection coefficient of the antenna radome with an effective dielectric constant of 6.8 and the thickness of 0.55 mm. Curve ③ indicates a curve of a reflection coefficient of the antenna radome with an effective dielectric constant of 10.9 and the thickness of 0.55 mm. Curve ④ indicates a curve of a reflection coefficient of the antenna radome with an effective dielectric constant of 25 and the thickness of 0.55 mm. Curve ⑤ indicates a curve of a reflection coefficient of the antenna radome with an effective dielectric constant of 36 and the thickness of 0.55 mm. Mark 1 on the curve ① indicates that the return loss of the antenna module is −9.078 dB when the frequency is 27.999 GHz. Mark 2 on the curve ② indicates that the return loss of the antenna module is −3.9883 dB when the frequency is 28.008 GHz. Mark 3 on the curve ③ indicates that the return loss of the antenna module is −2.0692 dB when the frequency is 28 GHz. Mark 4 on the curve ④ indicates that the return loss of the antenna module is −0.60036 dB when the frequency is 28 GHz. The mark 4 on the curve ⑤, which coincides with the mark 4 on the curve ④, indicates that the return loss of the antenna module is −0.60036 dB when the frequency is 28 GHz. It can be seen that, as the effective dielectric constant of the antenna radome increases, the return loss of the antenna module also gradually increases. By changing the effective dielectric constant of the antenna radome, the return loss of the antenna module can be flexibly adjusted.

Figure 39:
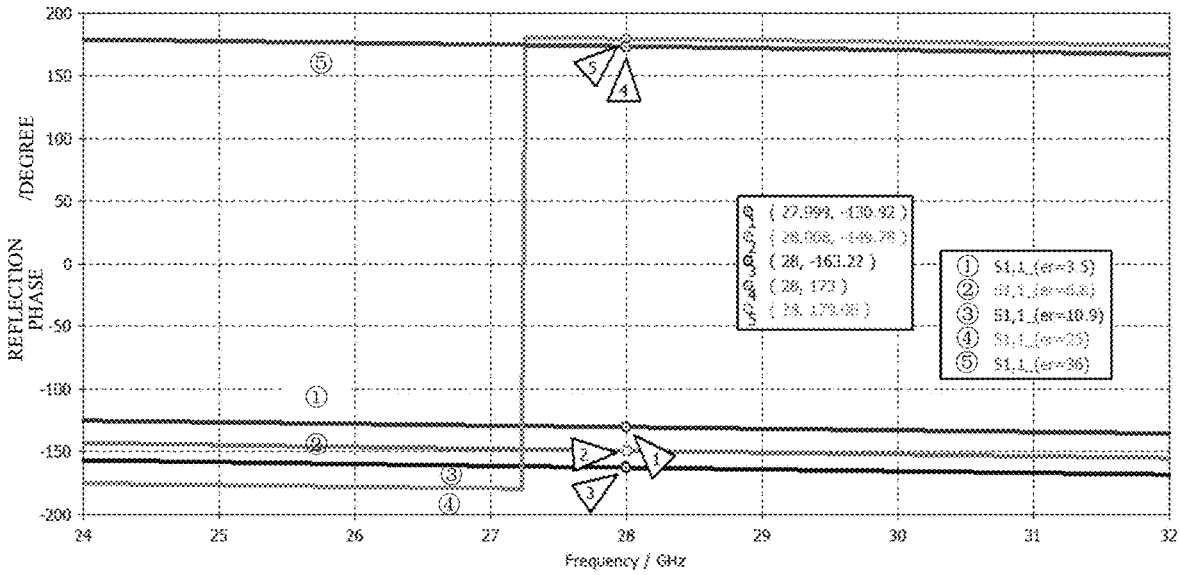
FIG. 39 is a schematic diagram of curves of a reflection phase of an antenna radome with a thickness of 0.55 mm in terms of different dielectric constants.

FIG. 39 is a schematic diagram of curves of a reflection phase of an antenna radome with a thickness of 0.55 mm in terms of different dielectric constants. In FIG. 39, the abscissa denotes the frequency, unit: GHz and the ordinate denotes the reflection phase, unit: degrees. Curve ① indicates a curve of a reflection phase of the antenna radome with an effective dielectric constant of 3.5 and the thickness of 0.55 mm. Curve ② indicates a curve of a reflection phase of the antenna radome with an effective dielectric constant of 6.8 and the thickness of 0.55 mm. Curve ③ indicates a curve of a reflection phase of the antenna radome with an effective dielectric constant of 10.9 and the thickness of 0.55 mm. Curve ④ indicates a curve of a reflection phase of the antenna radome with an effective dielectric constant of 25 and the thickness of 0.55 mm. Curve ⑤ indicates a curve of a reflection phase of the antenna radome with an effective dielectric constant of 36 and the thickness of 0.55 mm. Mark 1 on the curve ① indicates that the reflection phase of the antenna module is −130.92 degrees when the frequency is 27.999 GHz. Mark 2 on the curve ② indicates that the reflection phase of the antenna module is −149.78 degrees when the frequency is 28.008 GHz. Mark 3 on the curve ③ indicates that the reflection phase of the antenna module is −163.22 degrees when the frequency is 28 GHz. Mark 4 on the curve ④ indicates that the reflection phase of the antenna module is 173 degrees when the frequency is 28 GHz. Mark 5 on the curve ⑤ indicates that the reflection phase of the antenna module is 179.06 degrees when the frequency is 28 GHz. It can be seen that, when the effective dielectric constant of the antenna radome is less than 10.9, the reflection phase of the antenna module is greater than −125 degrees. When the effective dielectric constant of the antenna radome is greater than 25, the reflection phase of the antenna module is close to 180 degrees. When the effective dielectric constant of the antenna radome is 25, the reflection phase of the antenna module is abruptly changed from −180 degrees to 180 degrees, which crosses the range where the reflection phase is 0. That is, when the effective dielectric constant of the antenna radome is 25, the range of the reflection phase that the antenna module can be adjusted is wide, and when the reflection phase is equal to 0, the in-phase reflection condition is satisfied. In this case, the distance between the antenna module and the antenna radome can be a quarter wavelength, reducing the overall thickness of the antenna module.

Figure 40:
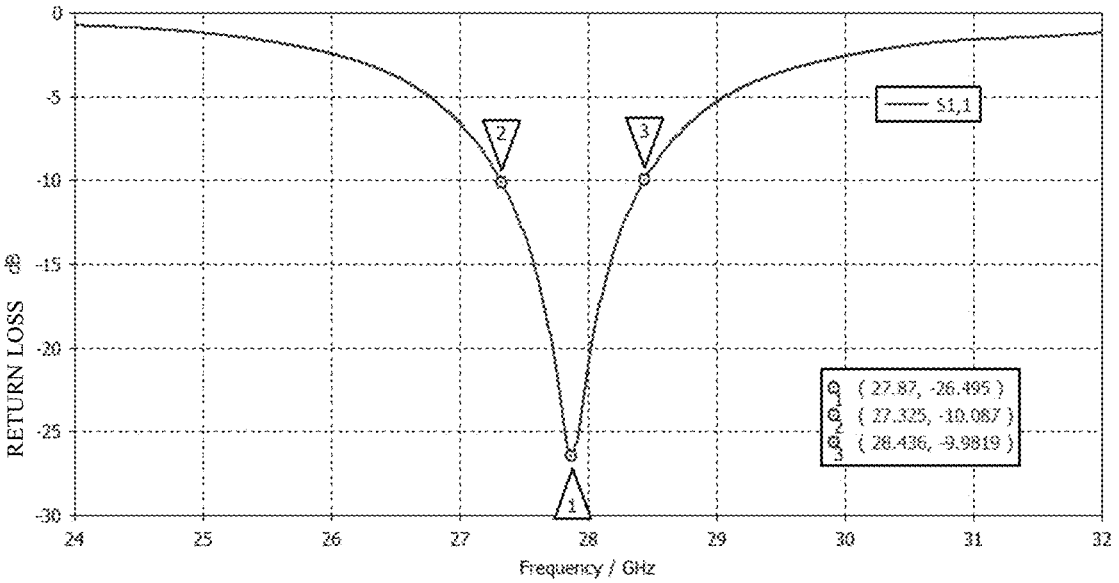
FIG. 40 is a schematic diagram of a curve of S11 (shortened as S11 curve) of a 28 GHz antenna module in free space.

FIG. 40 is a schematic diagram of a S11 curve of a 28 GHz antenna module in free space. In the case of S11<−10 dB, the impedance bandwidth is 1.111 GHz, covering 27.325 GHz~28.436 GHz. The antenna module covers the n261 band. As illustrated in FIG. 40, the horizontal axis represents the frequency of the radio frequency signal, unit GHz; the vertical axis represents the return loss S11, unit dB. In FIG. 40, the lowest point of the curve is a corresponding frequency of the radio frequency signal, which means that when the antenna module operates at this frequency, the return loss of the radio frequency signal is the smallest. That is, the frequency corresponding to the lowest point in the curve is the center frequency of the curve. For the curve, a frequency interval less than or equal to −10 dB is the impedance bandwidth of the radio frequency signal corresponding to the antenna radome of a corresponding thickness. For example, when the frequency band of the radio frequency signal is n261, the center frequency of the radio frequency signal is 27.87 GHz. In this case, the return loss is smallest and is −26.495 dB, the frequency interval of S11≤−10 dB is 27.325 GHz~28.436 GHz, and the impedance bandwidth is 1.111 GHz.

Figure 41:
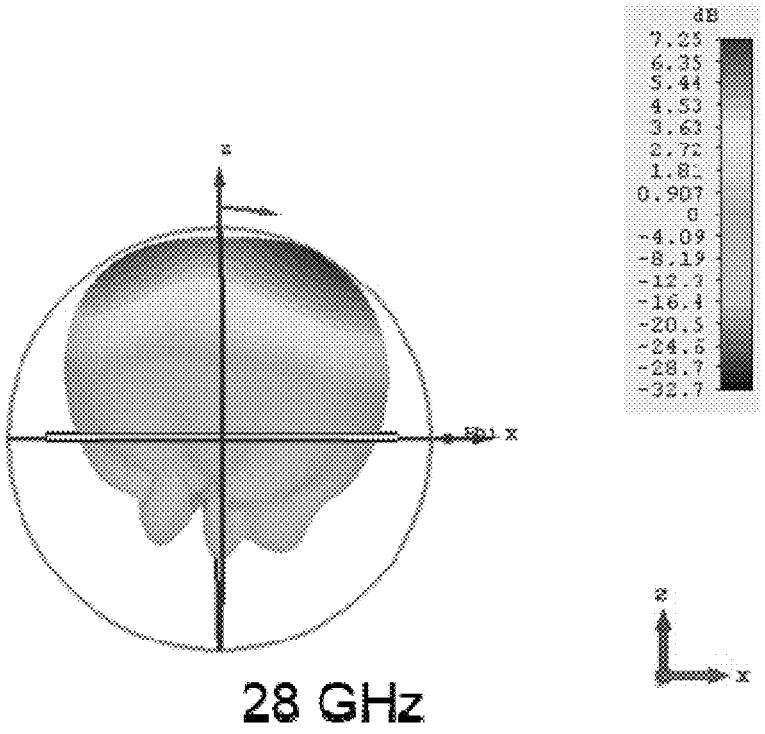
FIG. 41 is a gain pattern of the 28 GHz antenna module at a resonance frequency in free space.

FIG. 41 is a gain pattern (or radiation pattern) of the 28 GHz antenna module at a resonance frequency (point) in free space. The vertical axis represents the radiation direction of the radio frequency signal, and the horizontal axis represents the radiation angle of the radio frequency signal relative to the direction of the main lobe. It can be seen that, due to the presence of the main board, there is some distortion in the gain pattern of the antenna module, and the peak gain of the antenna module is about 7.25 dB.

Figure 42:
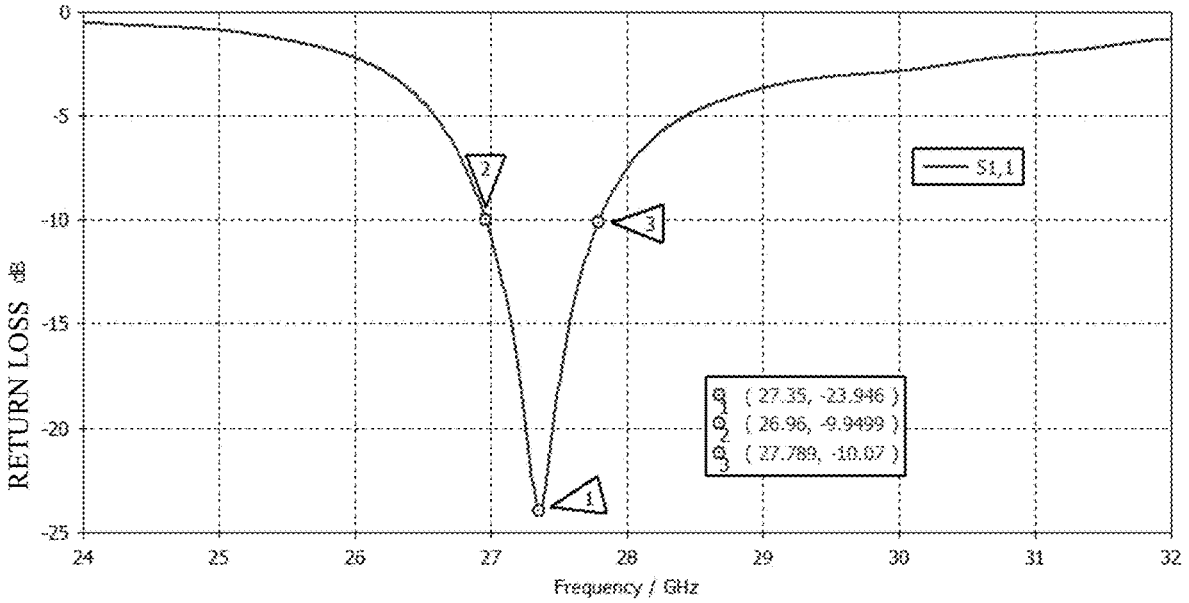
FIG. 42 is a schematic diagram of a S11 curve of a 28 GHz antenna module 5.35 mm away from a dielectric substrate in free space.

FIG. 42 is a schematic diagram of a S11 curve of a 28 GHz antenna module 5.35 mm away from a dielectric substrate in free space. In the case of S11<−10 dB, the impedance bandwidth is 0.829 GHz, covering 26.96 GHz~27.789 GHz. The antenna module covers part of the n257, n258, and n261 bands. As illustrated in FIG. 42, the horizontal axis represents the frequency of the radio frequency signal, unit GHz; the vertical axis represents the return loss S11, unit dB. In FIG. 42, the lowest point of the curve is a corresponding frequency of the radio frequency signal, which means that when the antenna module operates at this frequency, the radio frequency signal has the smallest return loss. That is, the frequency corresponding to the lowest point in the curve is the center frequency of the curve. For the curve, a frequency interval less than or equal to −10 dB is the impedance bandwidth of the radio frequency signal corresponding to the antenna radome of a corresponding thickness. For example, when the frequency band of the radio frequency signal includes n257, n258, and n261, the center frequency of the radio frequency signal is 27.35 GHz. In this case, the return loss is the smallest and is −23.946 dB, the frequency interval of S11≤−10 dB is 26.96 GHz~27.789 GHz, and the impedance bandwidth is 0.829 GHz.

Figure 43:
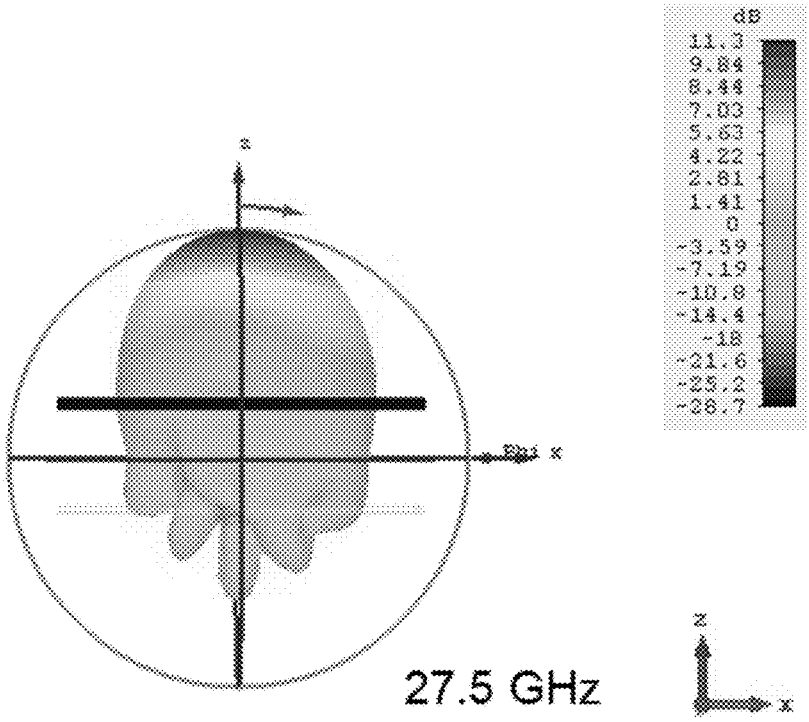
FIG. 43 is another gain pattern of a 27.5 GHz antenna module at a resonance frequency in free space.

FIG. 43 is another gain pattern of a 27.5 GHz antenna module at a resonance frequency in free space. The vertical axis represents the radiation direction of the radio frequency signal, and the horizontal axis represents the radiation angle of the radio frequency signal relative to the direction of the main lobe. It can be seen that, at the resonance frequency, the gain is large and directivity is improved, and the peak gain reaches 11.3 dB, which is in accordance with the distance formula between antenna radome and antenna module.

Figure 44:
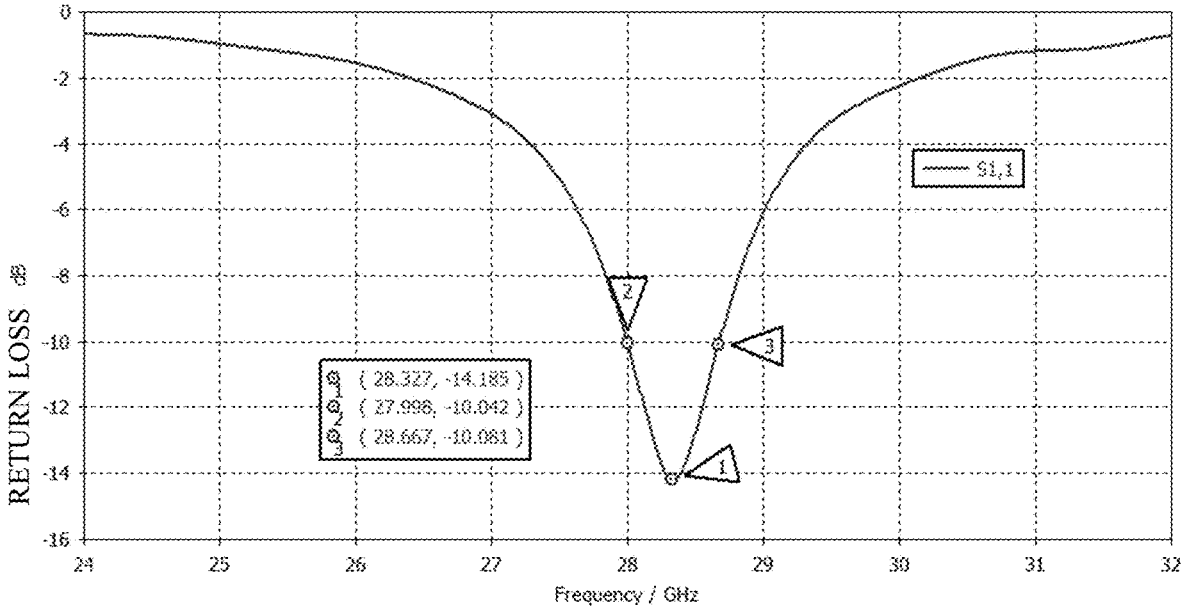
FIG. 44 is a schematic diagram of a S11 curve of a 28.5 GHz antenna module 2.62 mm away from a dielectric substrate in free space.

FIG. 44 is a schematic diagram of a S11 curve of a 28.5 GHz antenna module 2.62 mm away from a dielectric substrate in free space. In the case of S11<−10 dB, the impedance bandwidth is 0.669 GHz, covering 27.998 GHz~28.667 GHz. The antenna module covers part of the n257 and n261 bands. As illustrated in FIG. 44, the horizontal axis represents the frequency of the radio frequency signal, unit GHz; the vertical axis represents the return loss S11, unit dB. In FIG. 44, the lowest point of the curve is a corresponding frequency of the radio frequency signal, which means that when the antenna module operates at this frequency, the return loss of the radio frequency signal is the smallest. That is, the frequency corresponding to the lowest point in the curve is the center frequency of the curve. For the curve, a frequency interval less than or equal to −10 dB is the impedance bandwidth of the radio frequency signal corresponding to the antenna radome of a corresponding thickness. For example, when the frequency band of the radio frequency signal includes n257 and n261, the center frequency of the radio frequency signal is 28.327 GHz. In this case, the return loss is the smallest and is −14.185 dB, the frequency interval of S11≤−10 dB is 27.998 GHz~28.667 GHz, and the impedance bandwidth is 0.669 GHz.

Figure 45:
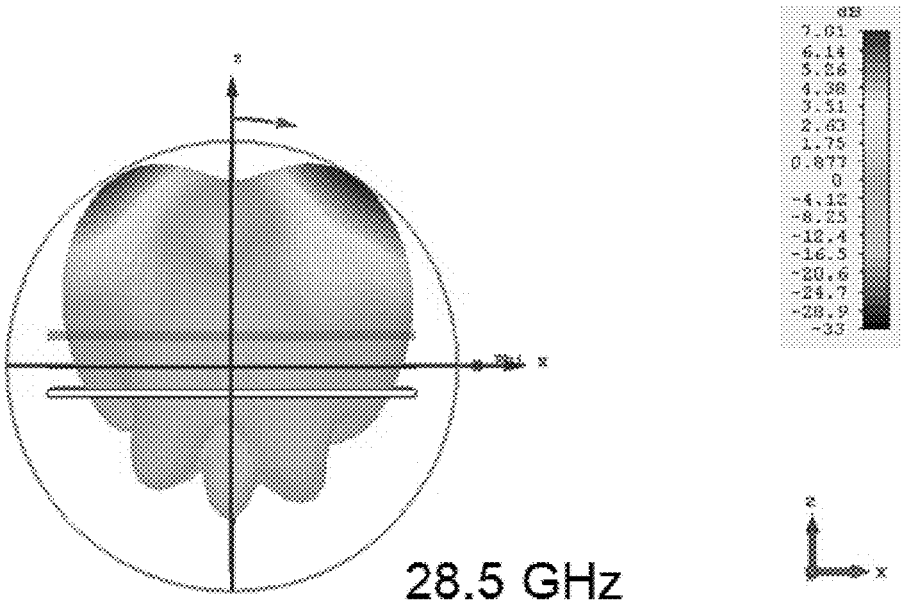
FIG. 45 is another gain pattern of a 28 GHz antenna module at a resonance frequency in free space.

FIG. 45 is another gain pattern of a 28 GHz antenna module at a resonance frequency in free space. The vertical axis represents the radiation direction of the radio frequency signal, and the horizontal axis represents the radiation angle of the radio frequency signal relative to the direction of the main lobe. It can be seen that, at the resonance frequency, the gain pattern of the antenna module is split and the gain is not improved, indicating that the use of resonance structure in this case does not improve the gain of the antenna module.

Figure 46:
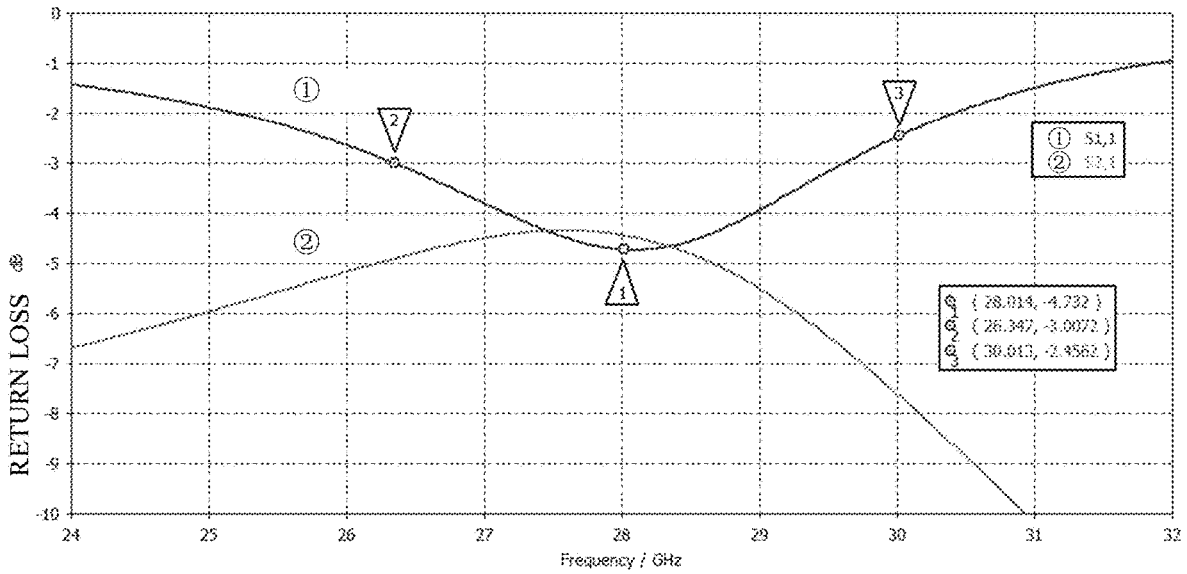
FIG. 46 is a schematic diagram of curves of S11 and S21 of an antenna module integrated with a resonance structure.

FIG. 46 is a schematic diagram of curves of S11 and S21 of an antenna module integrated with a resonance structure. In FIG. 46, the horizontal axis is the frequency of the radio frequency signal, unit GHz; the vertical axis represents the return loss S11, unit dB. In FIG. 46, curve ① represents a schematic diagram of S11 curve of the antenna module, and curve ② represents a schematic diagram of curve of S21 of the antenna module. For the curve ①, it can be seen that, at mark 1, the frequency is 28.014 GHz and a corresponding return loss is −4.732 dB; at mark 2, the frequency is 26.347 GHz and a corresponding return loss is −3.0072 dB; at mark 3, the frequency is 30.013 GHz and a corresponding return loss is −2.4562 dB. In the range of 27.4 GHz-28.3 GHz, the S11 curve is below the curve of S21 (shortened as S21 curve), indicating that the return loss of the antenna module is small, the transmission performance is high, and the overall performance of the antenna module is good, covering the n261 band.

Figure 47:
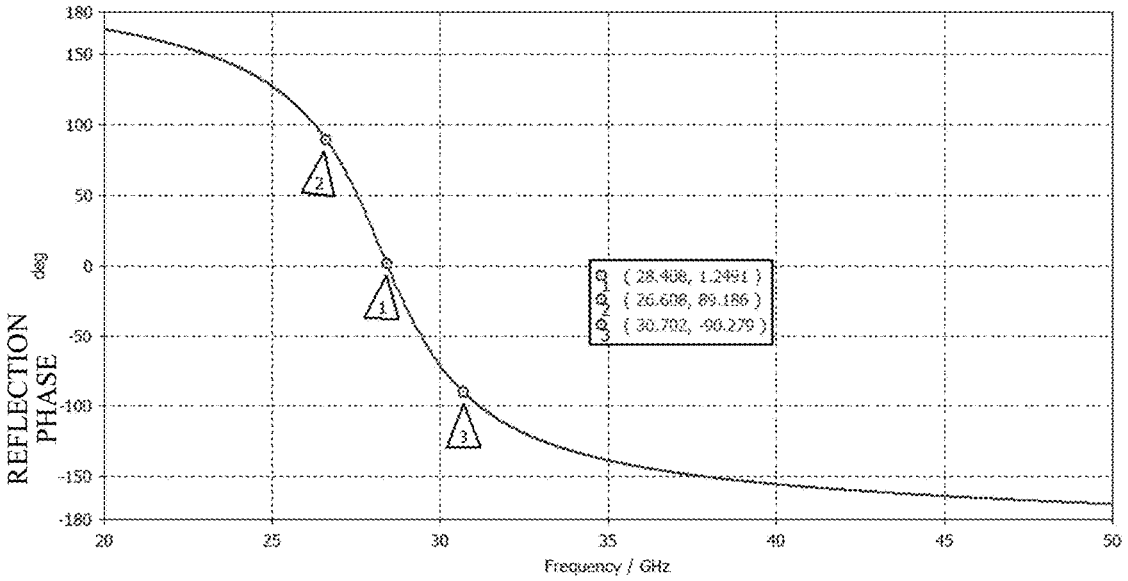
FIG. 47 is a distribution diagram of a reflection phase of an antenna module integrated with a resonance structure.

FIG. 47 is a distribution diagram of a reflection phase of an antenna module integrated with a resonance structure. In FIG. 47, the horizontal axis represents the frequency of the radio frequency signal, unit GHz; the vertical axis represents the reflection phase, unit degree. In FIG. 47, the reflection phase corresponding to the 28.408 GHz frequency is 1.2491 degrees, the reflection phase corresponding to the 26.608 GHz frequency is 89.186 degrees, and the reflection phase corresponding to the 30.702 GHz frequency is −90.279 degrees. It can be seen that, around 28 GHz, the reflection phase is close to 0°, and between 26.608 GHz and 30.702 GHz, the reflection phase is between −90° and 90°, satisfying the in-phase reflection condition.

Figure 48:
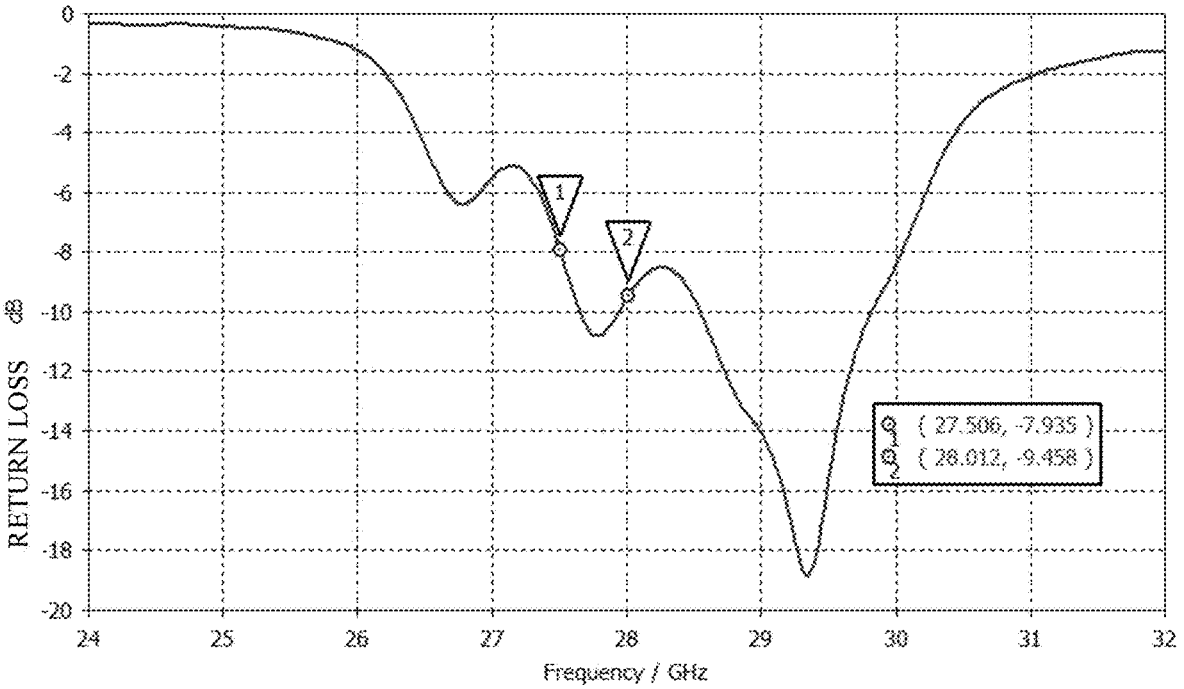
FIG. 48 is a schematic diagram of a S11 curve of a 28 GHz antenna module 2.62 mm away from a resonance structure in free space.

FIG. 48 is a schematic diagram of a S11 curve of a 28 GHz antenna module 2.62 mm away from a resonance structure in free space. As illustrated in FIG. 48, the horizontal axis represents the frequency of the radio frequency signal, unit GHz; the vertical axis represents the return loss S11, unit dB. In FIG. 48, it can be seen that, at mark 1, the frequency is 27.506 GHz and a corresponding return loss is −7.935 dB; at mark 2, the frequency is 28.012 GHz and a corresponding return loss is −9.458 dB. In FIG. 48, the lowest point of the curve is a corresponding frequency of the radio frequency signal, which means that when the antenna module operates at this frequency, the return loss of the radio frequency signal is the smallest. That is, the frequency corresponding to the lowest point in the curve is the center frequency of the curve. For the curve, a frequency interval less than or equal to −10 dB is the impedance bandwidth of the radio frequency signal corresponding to the antenna radome of a corresponding thickness. For example, when the frequency band of the radio frequency signal includes n257 and n261, the center frequency of the radio frequency signal is 29.3 GHz. In this case, the return loss is the smallest and is −18.8 dB, the frequency interval of S11≤−10 dB is 27.6 GHz~29.7 GHz, and the impedance bandwidth is 2.1 GHz.

Figure 49:
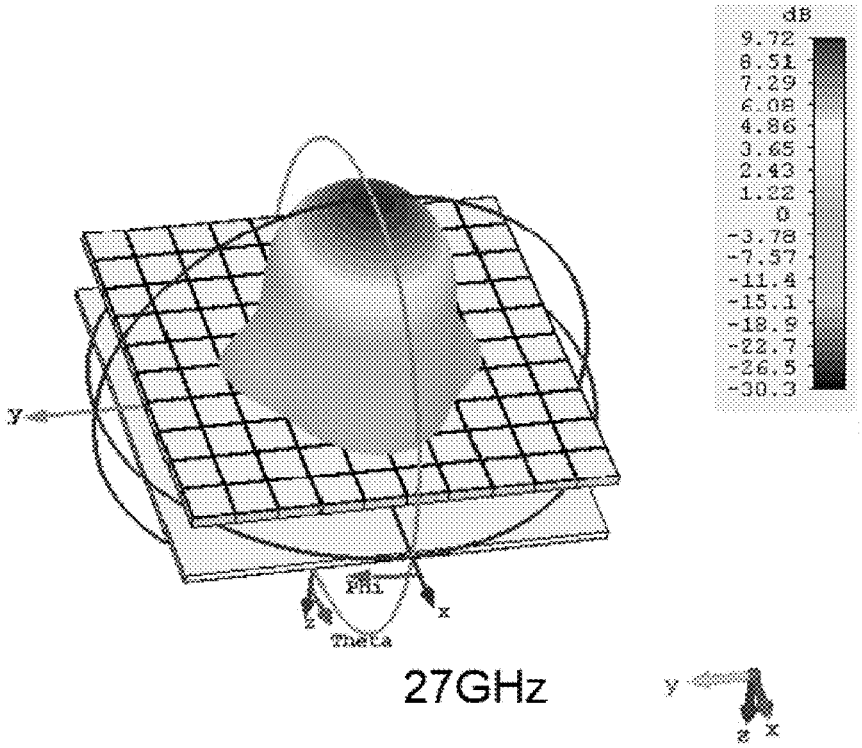
FIG. 49 is another gain pattern of the 27 GHz antenna module with a resonance structure at a resonance frequency in free space.

FIG. 49 is another gain pattern of the 27 GHz antenna module with a resonance structure at a resonance frequency in free space. The Z axis represents the radiation direction of the radio frequency signal, and the X axis and Y axis represent the radiation angle of the radio frequency signal relative to the direction of the main lobe. It can be seen that, at the resonance frequency, the gain pattern of the antenna module has no splitting or distortion, improving the gain of the antenna module, a distance between the antenna module and the antenna radome satisfying the distance formula, and shortening the distance between the antenna module and the antenna radome.

Figure 50:
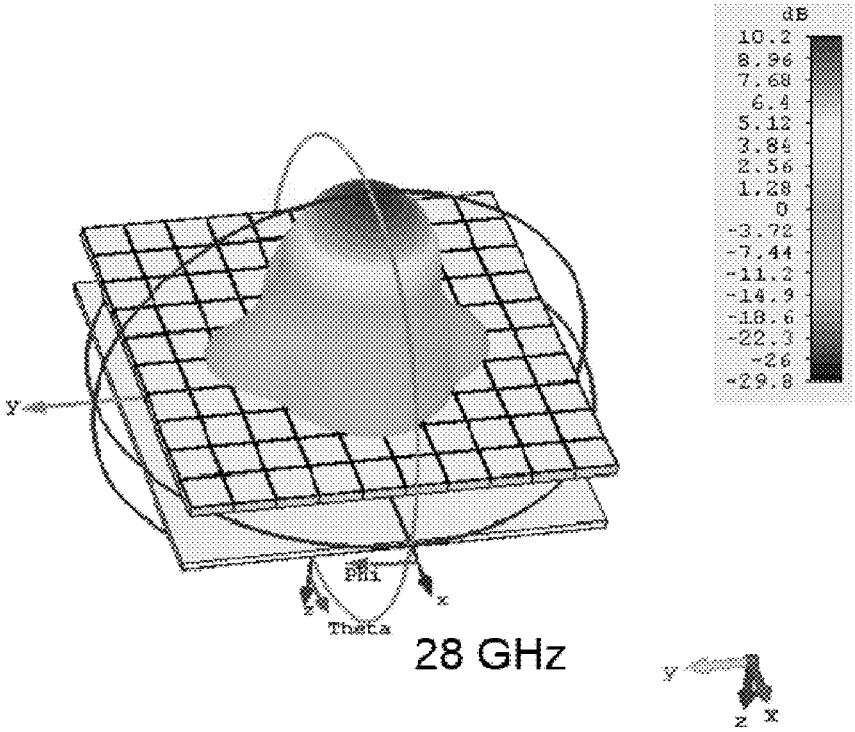
FIG. 50 is another gain pattern of the 28 GHz antenna module with a resonance structure at a resonance frequency in free space.

FIG. 50 is another gain pattern of the 28 GHz antenna module with a resonance structure at a resonance frequency in free space. The Z axis represents the radiation direction of the radio frequency signal, and the X axis and Y axis represent the radiation angle of the radio frequency signal relative to the direction of the main lobe. It can be seen that, at the resonance frequency, the gain pattern of the antenna module has no splitting or distortion, improving the gain of the antenna module, a distance between the antenna module and the antenna radome satisfying the distance formula, and shortening the distance between the antenna module and the antenna radome.

Figure 51:
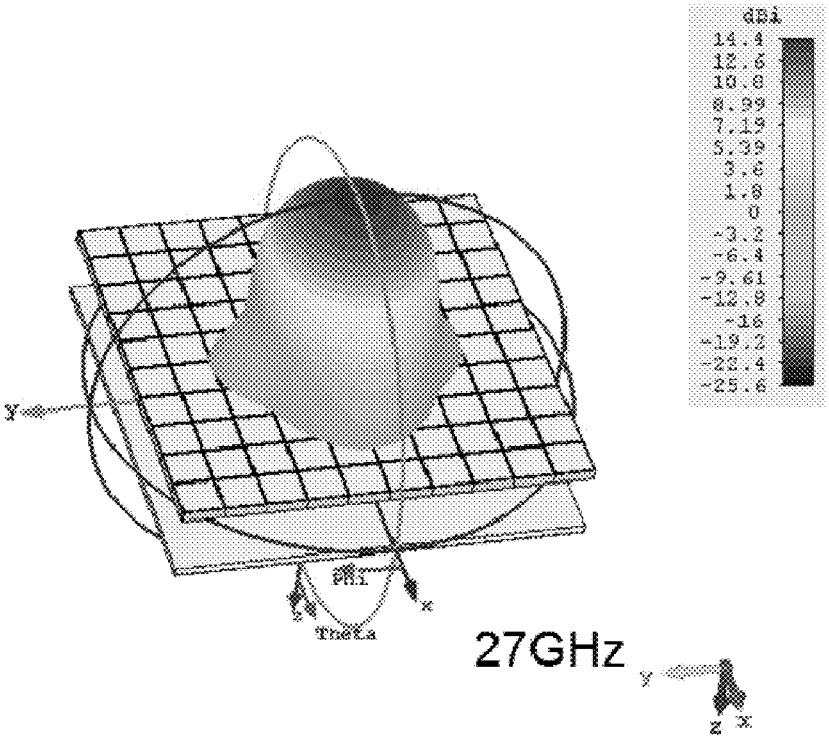
FIG. 51 is a gain pattern of an antenna module at 27 GHz, at 2.62 mm from a dielectric substrate integrated with a resonance structure.

FIG. 51 is a gain pattern of an antenna module at 27 GHz, at 2.62 mm from a dielectric substrate integrated with a resonance structure. The Z axis represents the directivity coefficient of the radio frequency signal, and the X axis and the Y axis represent the radiation angle of the radio frequency signal relative to the direction of the main lobe. It can be seen that, at 27 GHz, the gain pattern of the antenna module has no splitting or distortion, and the directivity coefficient of the antenna module is high, reaching 14.4 dBi.

Figure 52:
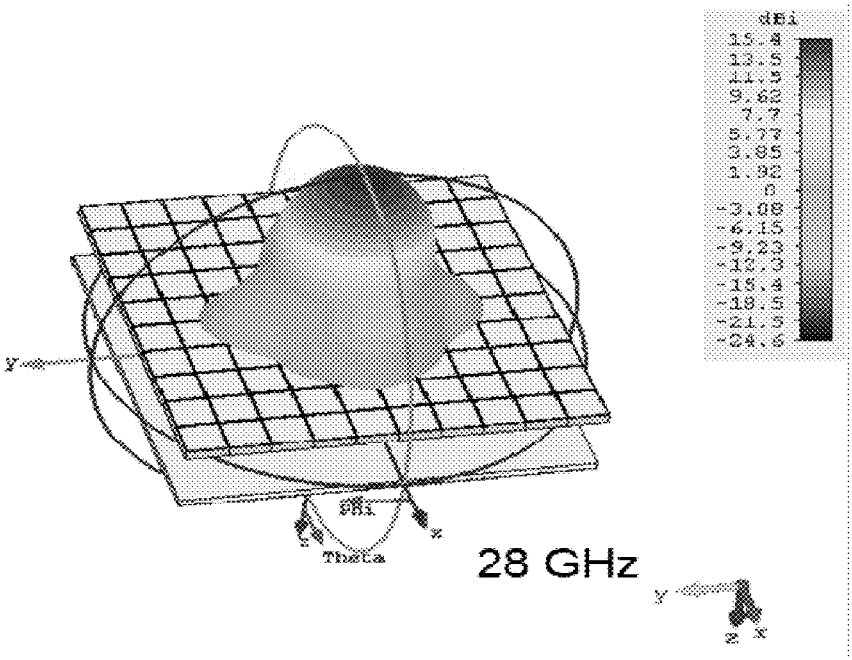
FIG. 52 is a gain pattern of an antenna module at 28 GHz, at 2.62 mm from a dielectric substrate integrated with a resonance structure.

FIG. 52 is a gain pattern of an antenna module at 28 GHz, at 2.62 mm from a dielectric substrate integrated with a resonance structure. The Z axis represents the directivity coefficient of the radio frequency signal, and the X axis and the Y axis represent the radiation angle of the radio frequency signal relative to the direction of the main lobe. It can be seen that, at 28 GHz, the gain pattern of the antenna module has no splitting or distortion, and the directivity coefficient of the antenna module is high, reaching 15.4 dBi.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law. In summary, the content of the specification should not be construed as limiting the present application.

What is claimed is:

1. An antenna device, comprising:

an antenna radome comprising a dielectric substrate and a resonance structure carried on the dielectric substrate; and an antenna module spaced apart from the antenna radome and configured to perform at least one of receiving and transmitting a radio frequency signal of a preset frequency band in a radiation direction which is directed toward the dielectric substrate and the resonance structure;

wherein the resonance structure has an in-phase reflection characteristic for the radio frequency signal of the preset frequency band, and a distance between a radiation surface of the antenna module and a surface of the resonance structure facing the antenna module is determined by a reflection phase difference of the antenna radome and a wavelength of the radio frequency signal of the preset frequency band transmitted in air;

wherein the resonance structure comprises a first resonance layer and a second resonance layer;

the first resonance layer has a plurality of first resonance units arranged at regular intervals;

the second resonance layer has a plurality of second resonance units arranged at regular intervals; and the first resonance unit has a side length of W1 and the second resonance unit has a side length of W2, wherein $W1 \leq W2 < P$ and P is a period of arrangement of the first resonance unit and the second resonance unit.

2. The antenna device of claim 1, wherein one of the following:

the resonance structure is located on one of:

a side of the dielectric substrate facing the antenna module; and a side of the dielectric substrate away from the antenna module; and the resonance structure is partially located on the side of the dielectric substrate away from the antenna module and partially located on the side of the dielectric substrate facing the antenna module.

3. The antenna device of claim 1, wherein at least part of the plurality of first resonance units of the first resonance layer are electrically connected with at least part of the plurality of second resonance units of the second resonance layer through vias.

4. The antenna device of claim 1, wherein:

the resonance structure further comprises a carrier film layer; and the projection of the first resonance layer on the carrier film layer and the projection of the second resonance layer on the carrier film layer do not overlap at least in part.

5. The antenna device of claim 1, wherein:

the resonance structure comprises conductive lines arranged at intervals in a first direction and conductive lines arranged at intervals in a second direction; and the conductive lines arranged at intervals in the first direction and the conductive lines arranged at intervals in the second direction cross with one another to form a plurality of grid structures arranged in array.

6. The antenna device of claim 1, wherein the resonance structure comprises a plurality of grid structures arranged in array, each of the plurality of grid structures is surrounded by at least one conductive line, and two adjacent grid structures at least share part of the at least one conductive line.

7. The antenna device of claim 1, wherein the distance between the radiation surface of the antenna module and the surface of the resonance structure facing the antenna module satisfies a preset distance formula, and wherein the preset distance formula comprises the reflection phase difference of the antenna radome and the wavelength of the radio frequency signal of the preset frequency band transmitted in air.

8. The antenna device of claim 7, wherein the preset distance formula is:

$$h = \left(\frac{\phi R}{\pi} - 1\right)\frac{\lambda_0}{4} + N\frac{\lambda_0}{2},$$

wherein h represents a length of a center line from the radiation surface of the antenna module to the surface of the resonance structure facing the antenna module, the center line is a straight line perpendicular to the radiation surface of the antenna module, $\phi R$ represents the reflection phase difference of the antenna radome, $\lambda_0$ represents the wavelength of the radio frequency signal transmitted in the air, and N is a positive integer.

9. The antenna device of claim 8, wherein the length of the center line from the radiation surface of the antenna module to the surface of the resonance structure facing the antenna module is $$\frac{\lambda_0}{4},$$

when $\phi R=0$.

10. The antenna device of claim 8, wherein a directivity coefficient of the antenna module has a maximum value, and the maximum value is $$D_{max} = \frac{1+\phi R}{1-\phi R}.$$

11. The antenna device of claim 1, wherein the antenna radome has a thickness satisfying the following formula:

$$(n-1)\times\frac{\lambda_1}{2} < d < n\times\frac{\lambda_1}{2},\ \lambda_1 = \frac{\lambda_0}{\sqrt{\varepsilon}};$$

wherein d represents the thickness of the antenna radome, $\lambda_1$ represents a wavelength of the radio frequency signal transmitted in the antenna radome, $\lambda_0$ represents a wavelength of the radio frequency signal transmitted in air, $\varepsilon$ represents an effective dielectric constant of the antenna radome, and n is a positive integer.

12. The antenna device of claim 1, wherein the preset frequency band at least comprises all-bands of millimeter wave of the 3rd generation partnership project (3GPP).

13. The antenna device of claim 12, wherein:

the antenna radome has a reflection phase ranging from −90° to 90° when the preset frequency band ranges from 26.6 GHz to 30.7 GHz; and the antenna radome has a reflection phase of 0° when the preset frequency band is 28 GHz.

14. An electronic device comprising a main board and the antenna device of claim 1, wherein the antenna module is electrically coupled with the main board and is configured to perform at least one of receiving and transmitting a radio frequency signal through the antenna radome under control of the main board.

15. The electronic device of claim 14, further comprising a battery cover, wherein the battery cover serves as the dielectric substrate and the battery cover is made of any one or more of plastic, glass, sapphire, and ceramic.

16. The electronic device of claim 15, wherein the battery cover comprises a back plate and a side plate surrounding the back plate, and when the side plate is located in a preset direction range for receiving/transmitting a radio frequency signal by the antenna module and the resonance structure is located on a side of the side plate facing the antenna module, the side plate serves as the dielectric substrate.

17. The electronic device of claim 15, wherein the battery cover comprises a back plate and a side plate surrounding the back plate, and when the back plate is located in a preset direction range for receiving/transmitting a radio frequency signal by the antenna module and the resonance structure is located on a side of the back plate facing the antenna module, the back plate serves as the dielectric substrate.

18. The electronic device of claim 14, further comprising a screen, the screen serving as the dielectric substrate.

19. The electronic device of claim 14, further comprising a protective cover;

wherein when the protective cover is located in a preset direction range for receiving/transmitting a radio frequency signal by the antenna module, the protective cover serves as the dielectric substrate.

* * * * *